US008158314B2

(12) United States Patent
Sakimura et al.

(10) Patent No.: US 8,158,314 B2
(45) Date of Patent: Apr. 17, 2012

(54) ORGANIC PHOTORECEPTOR AND IMAGE FORMING APPARATUS

(75) Inventors: Tomoko Sakimura, Tokyo (JP); Toyoko Shibata, Zama (JP); Shinichi Hamaguchi, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 486 days.

(21) Appl. No.: 12/370,920

(22) Filed: Feb. 13, 2009

(65) Prior Publication Data

US 2009/0208860 A1 Aug. 20, 2009

(30) Foreign Application Priority Data

Feb. 19, 2008 (JP) ..... 2008-037344

(51) Int. Cl.
*G03G 5/047* (2006.01)

(52) U.S. Cl. ..... 430/58.75; 430/59.1; 399/159

(58) Field of Classification Search ..... 430/58.75, 430/59.1, 72, 70, 71; 399/159
See application file for complete search history.

(56) References Cited

U.S. PATENT DOCUMENTS 5,338,634 A * 8/1994 Ueda ..... 430/58.75
2008/0166645 A1* 7/2008 Shibata et al. ..... 430/72
2009/0154960 A1* 6/2009 Sakimura et al. ..... 399/220

FOREIGN PATENT DOCUMENTS

JP 57-67934 A 4/1982
JP 2000-47408 A 2/2000

* cited by examiner

*Primary Examiner* — Janis L Dote
(74) *Attorney, Agent, or Firm* — Cantor Colburn LLP

(57) ABSTRACT

An object of the present invention is to form a high density electrostatic latent image on an organic photoreceptor via image exposure using a semiconductor laser or a light-emitting diode of an oscillation wavelength of 350-500 nm; and to provide an organic photoreceptor exhibiting improved sensitivity and repetition characteristics or improved dot reproducibility deterioration, and an image forming apparatus employing the organic photoreceptor. In an organic photoreceptor having a charge generating layer and a charge transporting layer on a conductive support, an organic photoreceptor wherein a charge generating layer incorporates a binder resin and a Br substituted pyranthrone-based compound and the spectral spectrum of the charge generating layer has maximum absorption values each in the region of 430-445 nm, 500-510 nm, and 530-545 nm.

8 Claims, 8 Drawing Sheets

ORGANIC PHOTORECEPTOR AND IMAGE FORMING APPARATUS

This application is based on Japanese Patent Application No. 2008-037344 filed on Feb. 19, 2008 in Japanese Patent Office, the entire content of which is hereby incorporated by reference.

TECHNICAL FIELD

The present invention relates to a newly developed organic photoreceptor and an image forming apparatus used for image formation employing an electrophotographic method for use in the field of copiers and printers.

BACKGROUND

Over recent years, there are increasing occasions in which electrophotographic copiers and printers are used in the common printing field and also in the color printing field. In the common printing field and the color printing field, there is a strong tendency to demand high quality digital black and white images or color images. For such demands, it has been proposed that highly detailed digital images are formed using a relatively short wavelength laser beam as an exposure light source. However, even when a detailed electrostatic latent image is formed on an electrophotographic photoreceptor using the relatively short wavelength laser beam of a narrowed exposure dot diameter, the current situation is that a finally formed electrophotographic image exhibits just insufficient image quality.

The reason is thought to be that photosensitive characteristics of an electrophotographic photoreceptor or charging characteristics of toner in a developer inadequately respond to characteristics required for formation of a detailed dot latent image or formation of a toner image.

Namely, with regard to the electrophotographic photoreceptor, an organic photoreceptor (hereinafter also referred to simply as a photoreceptor) conventionally developed for a relatively long wavelength laser exhibits poor sensitivity characteristics, whereby when image exposure is carried out using a relatively short wavelength laser beam of a narrowed exposure dot diameter, a formed dot latent image becomes unclear, resulting in a tendency to deteriorate dot image reproducibility.

Conventionally, as charge generating materials for a relatively short wavelength laser photoreceptor, anthanthrone-based pigments and pyranthrone-based compounds are well known (refer to Patent Document 1). However, with regard to such anthanthrone-based pigments and pyranthrone-based compounds as described in this patent publication, there is no description on special treatment therefor. Therefore, it is assumed that commercially available pigments are just simply used. Characteristics such as sensitivity, achieved when using these commercially available pigments, have made it impossible to realize adequate sensitivity or enhanced speed in high speed printers or copiers, employing relatively short wavelength lasers, which are expected to be developed from now on.

Further, to impart higher sensitivity to polycyclic quinone-based pigments, it is known that sublimation purification is carried out (refer to Patent Document 2). However, the sublimation purification method described in this patent publication is a simple sublimation purification method carried out only one time. Also, in cases in which pigments obtained via this sublimation purification are used, adequate sensitivity or enhanced speed has not yet been realized in high speed printers or copiers employing relatively short wavelength lasers.

[Patent Document 1] Unexamined Japanese Patent Application Publication (hereinafter referred to as JP-A) No. 2000-47408

[Patent Document 2] JP-A No. 57-67934

SUMMARY

The present invention was completed to solve the above problems. An object of the present invention is to form a high density electrostatic latent image on an organic photoreceptor via image exposure using a semiconductor laser or a light-emitting diode of an oscillation wavelength of 350-500 nm; and to provide an organic photoreceptor exhibiting improved sensitivity and repetition characteristics or improved dot reproducibility deterioration and an image forming apparatus employing the organic photoreceptor.

In view of the above problems, the present inventors conducted a series of investigations, and found that to solve the problems of the present invention, it was effective to use an organic photoreceptor exhibiting novel spectral absorption characteristics to improve sensitivity characteristics with respect to a relatively short wavelength laser beam in order to form a high density electrostatic latent image on an organic photoreceptor via image exposure using a semiconductor laser or a light-emitting diode of an oscillation wavelength of 350-500 nm and then to form an electrophotographic image exhibiting improved sensitivity and residual potential characteristics or improved dot reproducibility. Thus, the present invention was completed.

Namely, the present invention can be realized using an organic photoreceptor featuring the following constitutions:

1. In an organic photoreceptor having a charge generating layer and a charge transporting layer on a conductive support, an organic photoreceptor wherein a charge generating layer incorporates a binder resin and one or a plurality of compounds represented by following Formula (1) and the spectral spectrum of the charge generating layer has maximum absorption values each in the region of 430-445 nm, 500-510 nm, and 530-545 nm.

Formula (1)

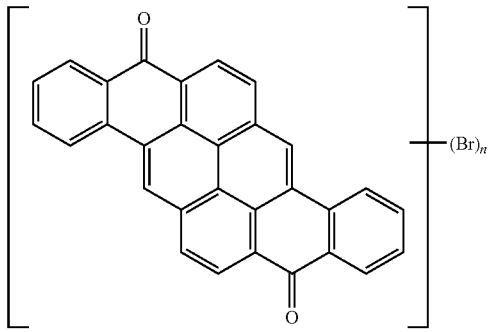

In Formula (1), n represents an integer of 1-6.

2. The organic photoreceptor, described in constitution 1, wherein a compound represented by above Formula (1) is a mixture of at least 2 types of compounds each differing in n.

3. The organic photoreceptor, described in constitution 1 or 2, wherein a charge transporting layer incorporates a compound represented by following Formula (2).

Formula (2)

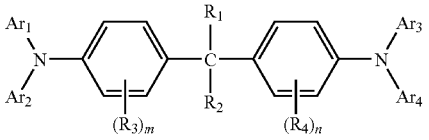

In Formula (2), $R_1$ and $R_2$ each represent an alkyl group or an aryl group independently and a ring structure may be formed by unification of $R_1$ and $R_2$; $R_3$ and $R_4$ each represent a hydrogen atom, an alkyl group, or an aryl group independently; $Ar_1$-$Ar_4$ each represent a substituted or unsubstituted aryl group and may be the same or differ; a ring structure may be formed by unification of $Ar_1$ and $Ar_2$ or $Ar_3$ and $Ar_4$; and m and n represent an integer of 1-4.

4. An image forming apparatus wherein there are provided an organic photoreceptor described in any of constitutions 1-3, a charging member to charge the organic photoreceptor, an exposure member to form an electrostatic latent image via exposure to an organic photoreceptor charged by the charging member, a developing member to form a toner image via toner development of the electrostatic latent image, and a transfer member to transfer the toner image from the organic photoreceptor to a transfer medium; and the exposure diameter in the primary scanning direction of writing in the exposure member is 10-50 μm.

5. An image forming apparatus wherein there are provided an organic photoreceptor described in any of constitutions 1-3, a charging member to charge the organic photoreceptor, an exposure member to form an electrostatic latent image via exposure to an organic photoreceptor charged by the charging member, a developing member to form a toner image via toner development of the electrostatic latent image, and a transfer member to transfer the toner image from the organic photoreceptor to a transfer medium; and the exposure member incorporates an exposure light source featuring monochromatic light of a wavelength region of 350-500 nm.

6. An image forming apparatus wherein there are provided an organic photoreceptor described in any of constitutions 1-3, a charging member to charge the organic photoreceptor, an exposure member to form an electrostatic latent image via exposure to an organic photoreceptor charged by the charging member, a developing member to form a toner image via toner development of the electrostatic latent image, and a transfer member to transfer the toner image from the organic photoreceptor to a transfer medium; and the exposure member incorporates a surface-emitting laser array as an exposure light source, featuring a wavelength region of 350-500 nm, having at least 3 laser beam emitting points both in length and width directions.

7. An image forming apparatus, described in any of constitutions 4-6, featuring a writing density of at least 1200 dpi.

Using the organic photoreceptor and the image forming apparatus of the present invention, in an electrographic image forming method employing a relatively short wavelength laser beam, a large potential attenuation value for unit exposure amount and excellent repetition characteristics can be realized, and a sharp dot latent image of a smaller diameter can be formed, whereby an electrophotographic image with improved dot reproducibility can be formed.

DESCRIPTION OF THE PREFERRED EMBODIMENT

Figure 1:
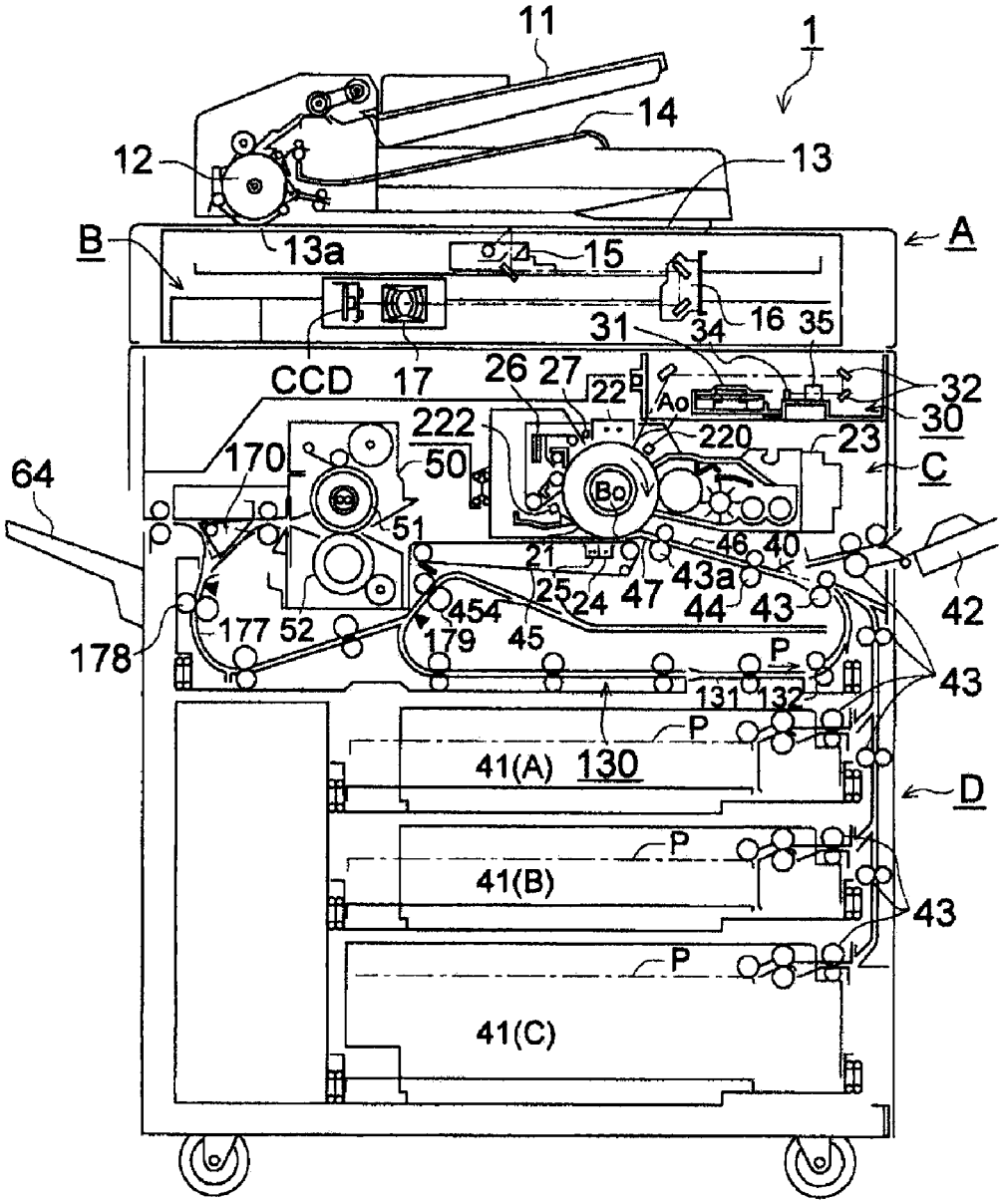
[FIG. 1] A schematic view showing incorporation of functions of the image forming apparatus of the present invention

The organic photoreceptor of the present invention will now be detailed.

In an organic photoreceptor incorporating a charge generating layer and a charge transporting layer on a conductive support, the organic photoreceptor of the present invention is characterized in that a charge generating layer incorporates a binder resin and a compound represented by Formula (1) and the spectral spectrum of the charge generating layer has maximum absorption values each in the region of 430-445 nm, 500-510 nm, and 530-545 nm.

Via the above constitutions, in an electrophotographic image forming method employing a relatively short wavelength laser beam, the organic photoreceptor of the present invention can form a highly detailed dot image; exhibits a large potential attenuation value for unit exposure amount and excellent repetition characteristics; and can form a sharp dot latent image of a smaller diameter and then an electrophotographic image with improved dot reproducibility.

The organic photoreceptor of the present invention will now be detailed.

Initially, the spectral spectrum of a charge generating layer according to the present invention is described below.

The spectral spectrum of a charge generating layer according to the present invention features maximum absorption values each in the region of 430-445 nm, 500-510 nm, and 530-545 nm.

The spectral spectrum of the charge generating layer was measured using UV-VIS Spectrophotometer V-530 (produced by JASCO Corp.) (scanning rate: 1000 nm/minute), wherein a charge generating layer was formed on a transparent polyester film at the same thickness as a photoreceptor.

With regard to the above absorption peaks, peak intensity can directly be read off from a spectral spectrum graph. However, when a peak is difficult to identify, identification can be carried out by drawing a differential curve of the spectral spectrum graph.

Further, when a plurality of absorption peaks are present each in the region of 430-445 nm, 500-510 nm, and 530-545 nm, intensity comparison is carried out among maximum absorption peaks in each of the regions.

When the organic photoreceptor of the present invention exhibits the above spectral spectrum characteristics, a large potential attenuation value for unit exposure amount and excellent repetition characteristics can be realized, and a sharp dot latent image of a smaller diameter and then an electrophotographic image with improved dot reproducibility can be formed via image exposure using monochromatic light such as a laser beam of a wavelength region of 380-500 nm capable of achieving a narrower beam diameter and enhanced resolution, while conventional laser exposure at a wavelength of 780 nm has been limited to a beam diameter of about 60 μm at about 600 dpi.

The reason for such effects of the present invention has not yet sufficiently figured out, being, however, thought to be that in addition to monomer absorption characteristics on the shorter wavelength side of a compound represented by above Formula (1), via highly developing of absorption characteristics on the longer wavelength side of aggregates, pared electrons in a light exited state are allowed to exist for a long period of time.

Next, the compound of Formula (1) of the present invention will now be described.

In the compound of Formula (1), the Br substituted number, being n, is 1-6, and these Br substituted points can be substituted with any point of $R_1$-$R_{14}$ of following Formula (3).

Formula (3)

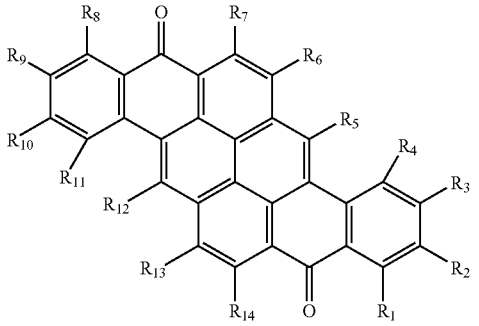

However, no method to accurately identify Br substituted points has yet been established, whereby these substituted points cannot accurately be identified.

Specific examples of pyranthrone compounds featuring a Br substituted number, being n, of 1-6 are listed below. However, pyranthrone compounds usable for the present invention are not limited only to the following ones.

C-1

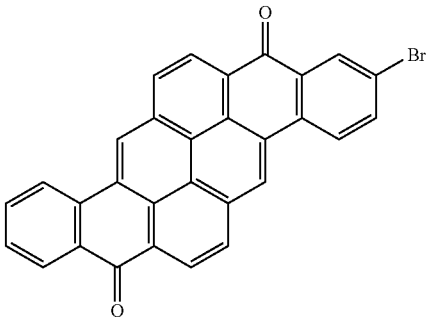

C-2

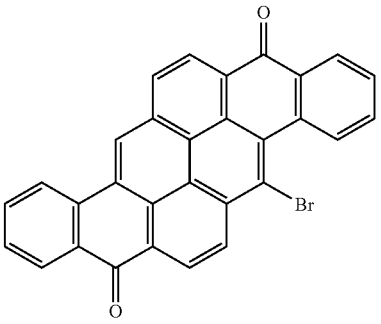

-continued

C-3

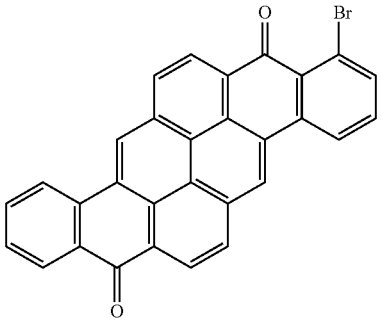

C-4

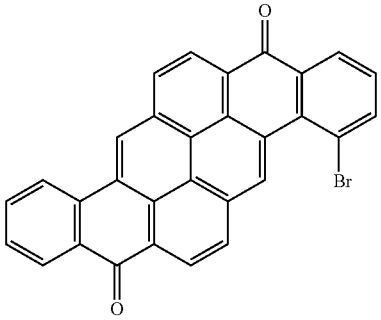

C-5

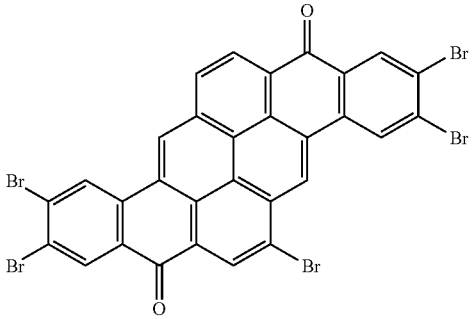

C-6

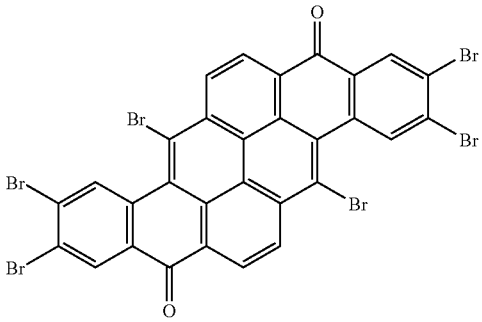

C-7

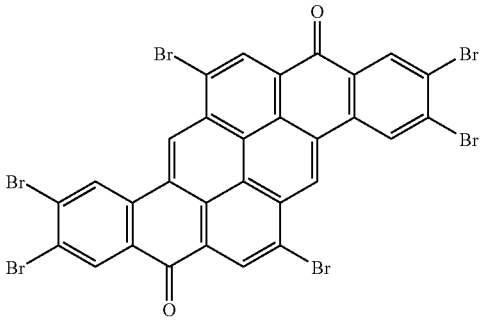

-continued
C-8
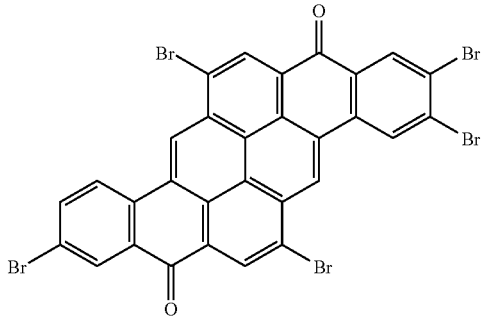
C-9
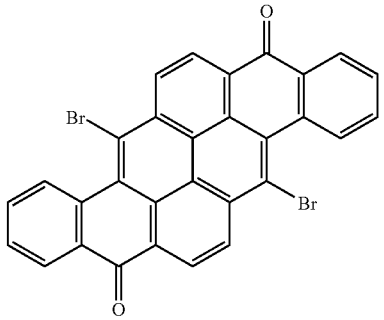
C-10
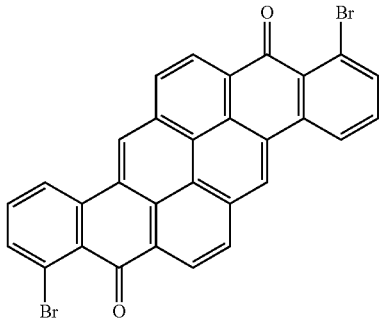
C-11
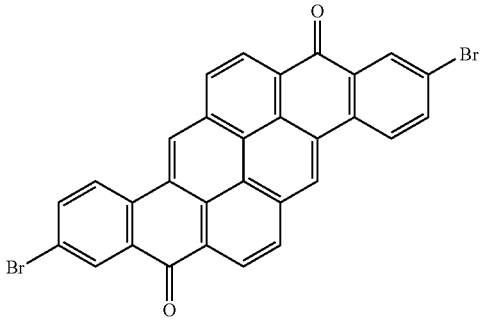
C-12
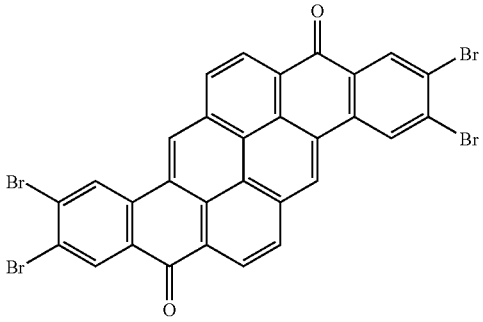
-continued
C-13
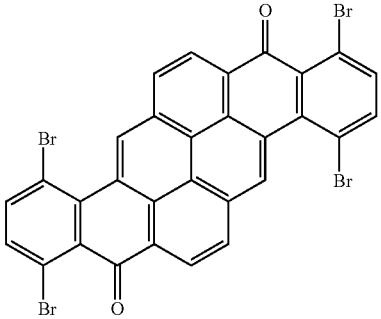
C-14
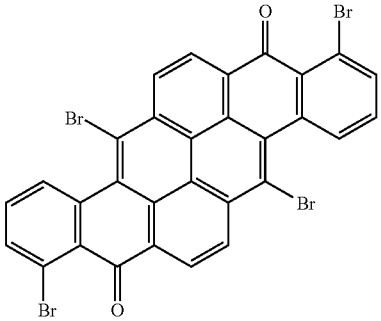
C-15
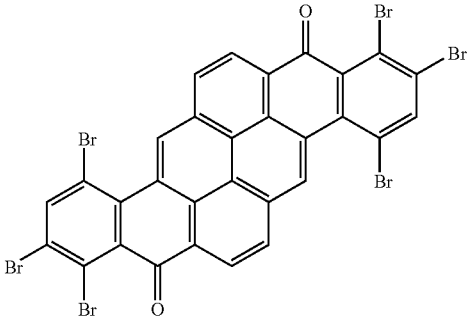
C-16
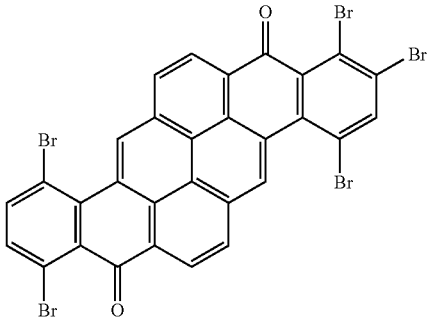
C-17
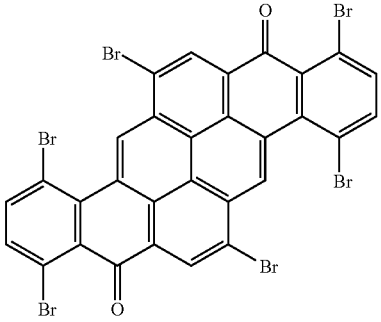

-continued

C-18

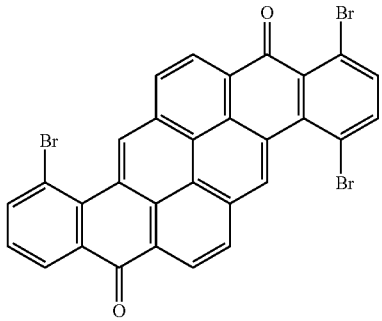

C-19

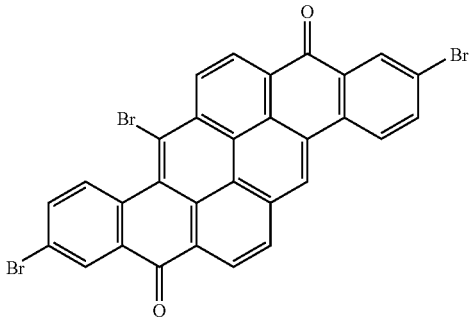

C-20

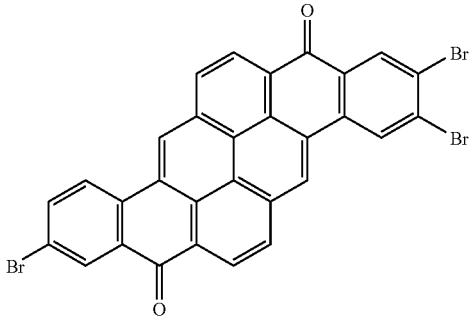

The number of bromine atoms allowed to join the molecular structure of a pyranthrone compound represented by Formula (1) can be controlled by changing the added amount of bromine during synthesis of the pyranthrone compound. Further, the number of bromine atoms joining a synthesized pyranthrone compound molecule can be confirmed via mass spectrometry known in the art.

Further, as shown in synthesis examples to be described later, a compound of above Formula (1) is obtained as a mixture of compounds having a Br substituted number, being n, of more than one. These mixed compounds are preferably used as a charge generating material for a charge generating layer.

It is more preferable that the peak intensity ratio of a compound of a Br substituted number, n=4 (exemplified compound C-13) determined via mass spectrometry be at least 50% based on other compounds having different Br substituted number.

In order to allow the spectral spectrum of a charge generating layer to have maximum absorption values each in the region of 430-445 nm, 500-510 nm, and 530-545 nm, controlling can be carried out, for example, via a purification method of the compound of Formula (1) or a dispersion method of pigment particles obtained by purification.

As a purification method to realize the absorption spectrum of the present invention, there can be listed, for example, a purification method employing a sublimation method such as multistage sublimation purification or fractional sublimation purification; and a method via thermal treatment in a high-boiling-point solvent. Purification is specifically preferably carried out via advanced sublimation purification. Herein, this advanced sublimation purification refers to multistage sublimation purification or fractional sublimation purification to be described later. It is difficult to realize the above spectral absorption spectrum characteristics via simple one-stage sublimation purification.

In the case of purification of a pyranthrone compound, the more times a purification process is repeated, the larger the content of the pyranthrone compound exhibiting a specified spectral spectrum becomes, resulting in higher purity. In this manner, the more times the purification process is repeated, the higher the mass ratio and purity of the pyranthrone compound exhibiting a specified spectral absorption spectrum becomes. It is presumed that pyranthrone molecules are formed into a certain crystal structure via the purification process. Namely, the number of repetition times of purification can adjust the spectral spectrum.

Further, a dispersion method to realize the absorption spectrum of the present invention includes, for example, ultrasonic dispersion, ball mill dispersion, and bead mill dispersion. Of these, bead mill dispersion employing dispersion beads is specifically preferable.

Using bead mill dispersion, shear loaded to pigment particles is allowed to change via the bead amount, dispersion disc rotation number, or dispersion duration. Thereby, the shape, primary particle diameter, and aggregation diameter of the pigment particles are controlled, whereby the spectral spectrum can be adjusted.

Synthesis examples of compounds represented by above Formula (1) according to the present invention will now be described.

SYNTHESIS EXAMPLE 1

(CGM-1)

Five grams of 8,16-pyranthrenedione and 0.25 g of iodine were dissolved in 50 g of chlorosulfuric acid, followed by dipping of 5.9 g of bromine. The resulting solution was heated at 60° C. for 5 hours while stirring and cooled to room temperature, followed by being poured into ice of 500 g. Subsequently, filtration, washing, and drying were carried out to give 8.6 g of a pigment raw product. Thereafter, 5.0 g of the pigment raw product was placed in a PYREX (a trademark) glass tube. This tube was placed inside a furnace which created a temperature gradient of about 20° C. upward from about 460° C. along the length of the tube (there was a temperature gradient of about 20° C. upward from about 460° C. for a length of 1 m). The glass tube was depressurized to about $1\times10^{-2}$ Pa, and the position, where the pigment raw product to be purified was placed, was heated at about 460° C. Generated vapor was moved to the lower temperature side of the tube and condensed to obtain 3.5 g of a sublimated material (CGM-1) condensed in the range of about 300-400° C.

As a result of mass spectrometry determination, there was confirmed a mixture of n=3 (exemplified compound C-18), n=4 (exemplified compound C-13), and n=5 (exemplified compound C-16), and the peak intensity ratio of n=3/n=4/n=5 was 30/65/5.

A charge generating layer according to the present invention needs to incorporate a binder. With no binder, unfavorable effects are produced, even when the spectral absorption spectrum falls within the range of the present invention.

Further, the ratio of a compound represented by Formula (1) to a binder is preferably 100-1000 parts by mass, specifically preferably 400-800 parts by mass, based on 100 parts by mass of the binder. When the ratio of the compound represented by Formula (1) to the binder is set to be high to allow the amount of the former to be at least the same as the latter, spectral absorption spectrum peaks can be made clearer.

a. Multistage Sublimation Purification

Multistage sublimation purification incorporates a sublimation process with at least 2 stages. In the initial stage, a sublimated material of an effective amount, for example, about 1-10% by mass, is condensed on a first substrate at a temperature slightly higher than the sublimation temperature of a pigment. Subsequently, in the second stage, the sublimation temperature is raised by the range of 10-100° C., and the sublimated material is condensed on a second substrate, whereby a highly purified pigment containing no volatile impurities or decomposed impurities can be obtained. In some cases, the process may incorporate at least 3 stages.

b. Fractional Sublimation Purification

Fractional sublimation purification is carried out in such a manner that a pigment is initially heated to temperature T1 in a first position to evaporate the pigment and volatile impurities contained therein. Subsequently, in a second position being kept at temperature T2 lower than T1, pigment vapor is condensed, and then volatile impurity vapor is condensed in a third position being kept at temperature T3 lower than T2. Non-sublimable impurities remain in the first position where the starting material has been placed, and therefore a purified pigment free from volatile impurities is obtained. The fractional sublimation purification of the present invention includes a conventionally known purification method such as train sublimation employing a glass tube.

Further, a charge transportation material of Formula (2) according to the present invention will now be described.

Examples of specific compounds of Formula (2) are listed below.

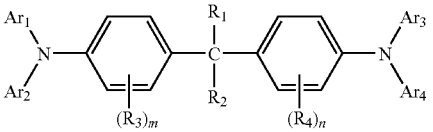

| CTM-No. | $Ar_1$ | $Ar_3$ | $Ar_2$ | $Ar_4$ |
|---|---|---|---|---|
| CTM-1 | 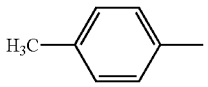 | 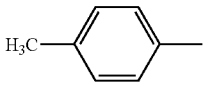 | 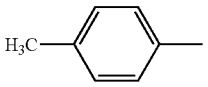 | 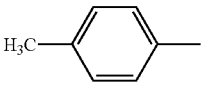 |
| CTM-2 | 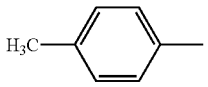 | 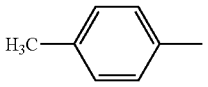 | 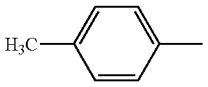 | 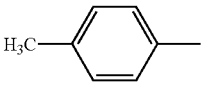 |
| CTM-3 | 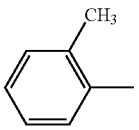 | 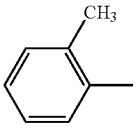 | 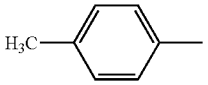 | 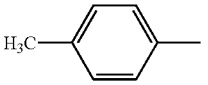 |
| CTM-4 | 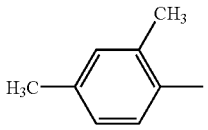 | 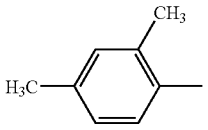 | 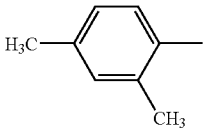 | 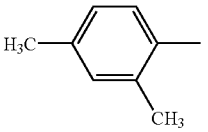 |
| CTM-5 | 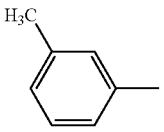 | 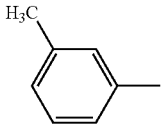 | 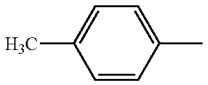 | 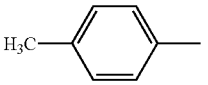 |
| CTM-6 | 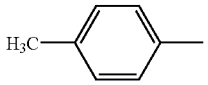 | 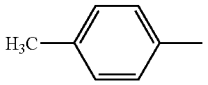 | 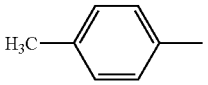 | 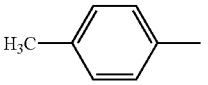 |
| CTM-7 | 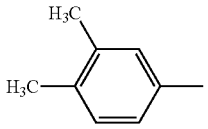 | 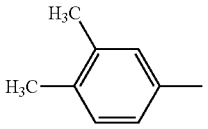 | 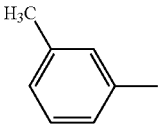 | 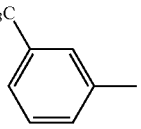 |
| CTM-8 | 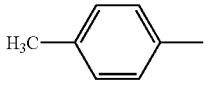 | 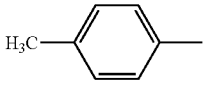 | 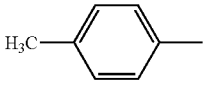 | 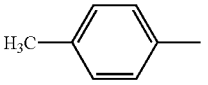 |

-continued
| | | | | |
|---|---|---|---|---|
| CTM-9 | 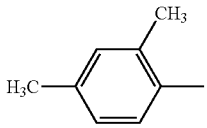 | 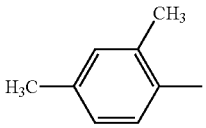 | 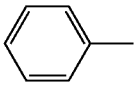 | 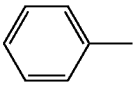 |
| CTM-10 | 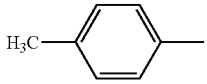 | 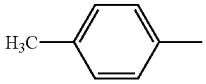 | 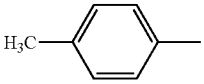 | 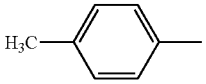 |
| CTM-11 | 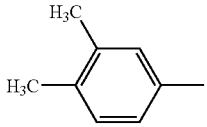 | 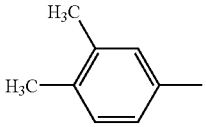 | 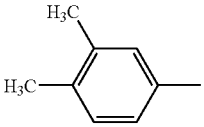 | 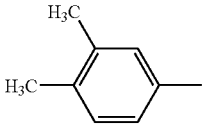 |
| CTM-12 | 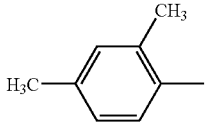 | 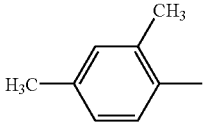 | 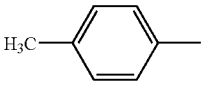 | 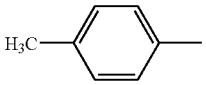 |
| CTM-13 | 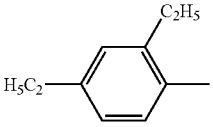 | 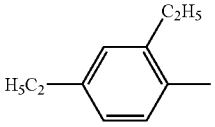 | 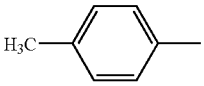 | 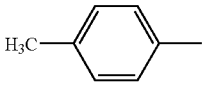 |
| CTM-14 | 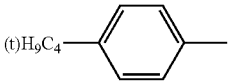 | 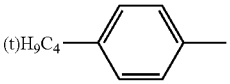 | 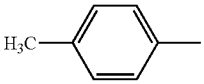 | 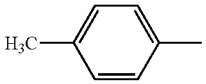 |
| CTM-15 | 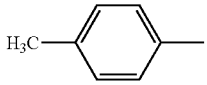 | 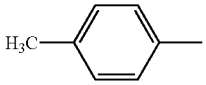 | 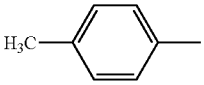 | 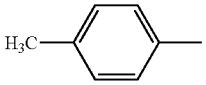 |
| CTM-No. | $R_1$ | $R_2$ | $(R_3)_m$ | $(R_4)_n$ |
|---|---|---|---|---|
| | | | 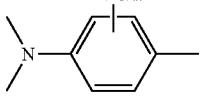 | 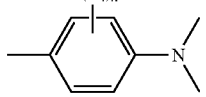 |
| CTM-1 | $-CH_3$ | $-CH_3$ | 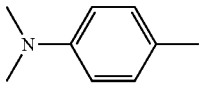 | 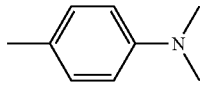 |
| CTM-2 | $-CH_3$ | $-C_2H_5$ | 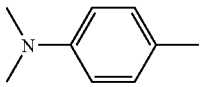 | 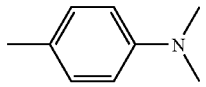 |
| CTM-3 | $-CH_3$ | $-C_3H_7$(i) | 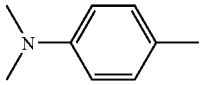 | 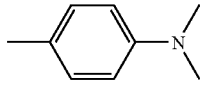 |
| CTM-4 | $-CH_3$ | $-C_4H_9$(n) | 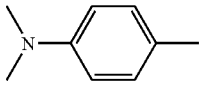 | 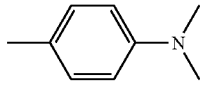 |
| CTM-5 | $-CH_3$ | 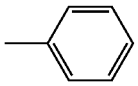 | 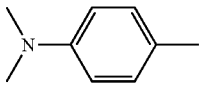 | 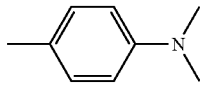 |
| CTM-6 | 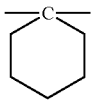 | | 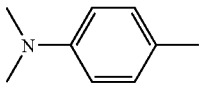 | 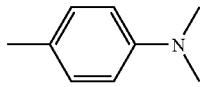 |

-continued
| | | | |
|---|---|---|---|
| CTM-7 | —$CH_3$ | —$CH_3$ | 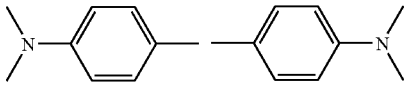 |
| CTM-8 | —H | —H | 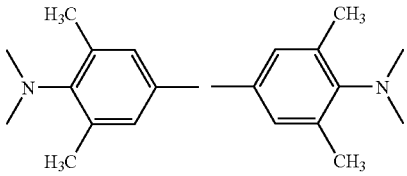 |
| CTM-9 | —$CH_3$ | —$CH_3$ | 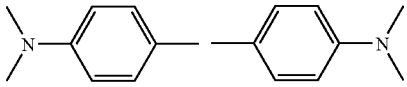 |
| CTM-10 | 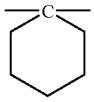 | | 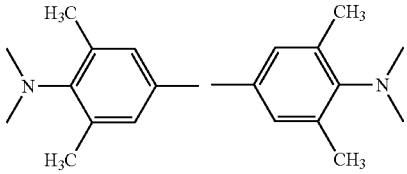 |
| CTM-11 | 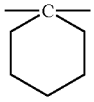 | | 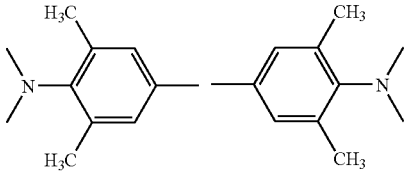 |
| CTM-12 | 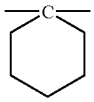 | | 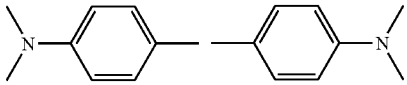 |
| CTM-13 | 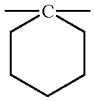 | | 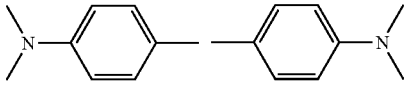 |
| CTM-14 | 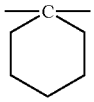 | | 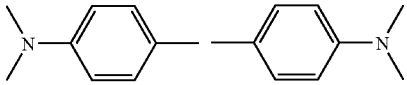 |
| CTM-15 | —$C_2H_5$ | —$C_2H_5$ | 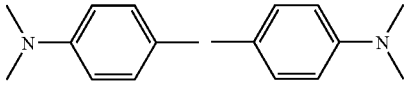 |
SYNTHESIS EXAMPLE 1
(CTM-6)
SYNTHESIS EXAMPLE 1
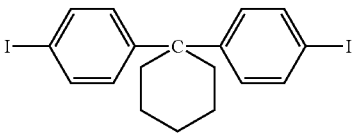
(a)
-continued
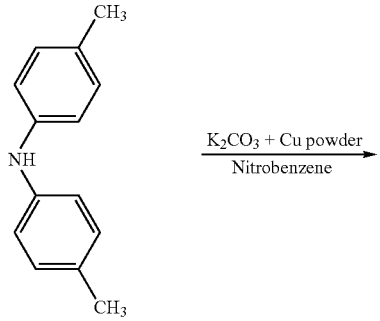
(b)

-continued

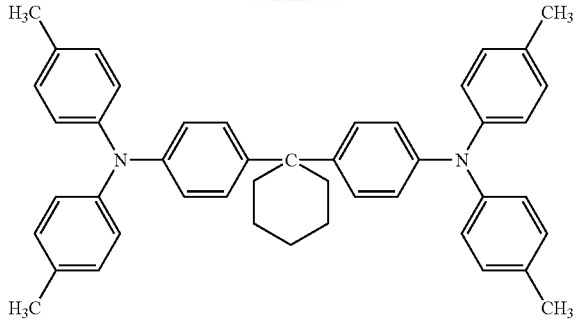

CTM-6

A 200-ml 14-neck flask is allowed to be equipped with a cooling pipe, a thermometer, and a nitrogen introducing pipe, and then a magnetic stirrer is arranged. This system is depressurized and the content is fully replaced with nitrogen. There were sequentially placed 8.1 g of (a), 12.0 g of (b), 16 g of $K_2CO_3$, 8.0 g of Cu powder, and 40 ml of nitrobenzene in this flask, followed by reaction at 190° C. for 30 hours while stirring. Thereafter, the above reaction liquid was subjected to steam distillation, and then the resulting product was isolated and purified via column chromatography using a developing solvent of hexane/toluene (4/1) to obtain 12 g of CTM-6 as the targeted material. This targeted material was verified via mass spectrometry and NMR.

An organic photoreceptor according to the present invention is one incorporating a charge generating layer and a charge transporting layer on a conductive support, wherein the charge generating layer incorporates a binder resin and a compound represented by above Formula (1), and the spectral spectrum of the charge generating layer has maximum absorption values each in the region of 430-445 nm, 500-510 nm, and 530-545 nm. The constitution of an organic photoreceptor featuring such a structure is described below.

In the present invention, the organic photoreceptor refers to an electrophotographic photoreceptor structured in such a manner that an organic compound is allowed to have at least one of a charge generating function and a charge transportation function required for the constitution of the electrophotographic photoreceptor, including any organic photoreceptors known in the art such as photoreceptors structured of a known organic charge generating material or organic charge transportation material, or photoreceptors structured of polymer complexes to provide a charge generating function and a charge transportation function.

The layer structure of the organic photoreceptor of the present invention includes, for example, layer structures listed below:

1) a structure wherein a charge generating layer and a charge transporting layer are sequentially layered as photosensitive layers on a conductive support;

2) a structure wherein a charge generating layer, a first charge transporting layer, and a second charge transporting layer are sequentially layered as photosensitive layers on a conductive support; and 3) a structure wherein a surface protective layer is further formed on the photosensitive layers of the photoreceptors of above 1) or 2).

The photoreceptor may have any structure of the above ones. Further, whenever the photoreceptor of the present invention is provided with any structure thereof, a sublayer (an intermediate layer) may be formed prior to formation of a photosensitive layer on a conductive support.

The charge transporting layer refers to a layer having a function to transport charged carriers, having been generated in a charge generating layer via light exposure, to the surface of an organic photoreceptor. Specific detection of the charge transportation function can be confirmed via photoconductivity detection with respect to a laminate of a charge generating layer and a charge transporting layer on a conductive support.

Further, a layer structure of the organic photoreceptor will now be described with main reference to the structure of above 1).

Conductive Support

As a conductive support used for a photoreceptor, either of a sheet-form or a cylindrical support may be employed. A cylindrical conductive support is preferable in order for an image forming apparatus to be designed to be compact.

The cylindrical conductive support refers to a cylindrical support which is needed to form images in an endless manner via rotation, being preferably a conductive support featuring a straightness of at most 0.1 mm and a deflection of at most 0.1 mm.

As a conductive material, there can be used a metal drum such as aluminum or nickel, a plastic drum deposited with aluminum, tin oxide, or indium oxide, or a paper or plastic drum coated with a conductive substance. A conductive support preferably features a specific resistance of at most $10^3$ Ωcm at normal temperature. As the conductive support of the present invention, an aluminum support is most preferable. As the aluminum support, a support, incorporating a component such as manganese, zinc, or magnesium in addition to aluminum as a main component, is also used.

Intermediate Layer

In the present invention, an intermediate layer is preferably provided between a conductive support and a photosensitive layer.

An intermediate layer used for the present invention preferably incorporates an N-type semiconductive particle. The N-type semiconductive particle refers to a particle wherein the main charge carrier thereof is an electron. Namely, since the main charge carrier is an electron, an intermediate layer, incorporating the N-type semiconductive particle in an insulating binder, effectively inhibits hole injection from a substrate, and has minimal blocking properties against electrons from a photosensitive layer.

As an N-type semiconductive particle, titanium oxide ($TiO_2$) or zinc oxide ($ZnO_2$) is preferable. Of these, titanium oxide is specifically preferably used.

As an N-type semiconductive particle, a fine particle of a number average primary particle diameter in the range of 3.0-200 nm is used. A range of 5 nm-100 nm is specifically preferable. The number average primary particle diameter refers to a value of the Fere direction average diameter determined via observation and image analysis of 100 particles as primary particles which are randomly selected from fine particles observed with a transmission electron microscope at a magnification of 10000. An N-type semiconductive particle of a number average primary particle diameter of less than 3.0 nm tends not to be uniformly dispersed in an intermediate layer binder, whereby aggregated particles are easily formed. Then, the aggregated particles become charge traps, resulting in a tendency to generate residual electricity increase. In contrast, an N-type semiconductive particle of a number average primary particle diameter of more than 200 nm tends to form large undulations on the surface of an intermediate layer, resulting in a tendency to produce deteriorated dot images through these large undulations. Further, the N-type semiconductive particle of a number average primary particle diameter of more than 200 nm tends to be deposited in a dispersion and then aggregates are likely to be generated, resulting in a tendency to produce deteriorated dot images.

Crystal forms of the above titanium oxide particle include an anatase, a rutile, a brookite, and an amorphous form. Of these, a rutile-form titanium oxide pigment or an anatase-form titanium oxide pigment is most preferable as the N-type semiconductive particle of the present invention, since rectifying properties of charge passing through an intermediate layer are enhanced: namely electron mobility is enhanced; charged potential is stabilized; residual potential increase is prevented; and dot image deterioration is prevented.

As the N-type semiconductive particle, those surface-treated with a polymer containing a methylhydrogen siloxane unit are preferable. A polymer containing the methylhydrogen siloxane unit featuring a molecular weight of 1000-20000 enhances surface treatment effects. Thereby, rectifying properties of the N-type semiconductor particle is enhanced. Accordingly, by using an intermediate layer incorporating such an N-type semiconductive particle, occurrence of black spots is prevented and effects to reproduce excellent dot images are expressed.

As a polymer containing a methylhydrogen siloxane unit, a copolymer containing —(HSi($CH_3$)O)— structure unit and another structure unit (namely another siloxane unit) is preferable. As another siloxane unit, preferable are a dimethylsiloxane unit, a methylethylsiloxane unit, a methylphenylsiloxane unit, and a diethylsiloxane unit. Of these, dimethylsiloxane is specifically preferable. The ratio of the methylhydrogen siloxane unit in the copolymer is 10-99 mol %, preferably 20-90 mol %.

The methylhydrogen siloxane copolymer may be any of a random copolymer, a block copolymer, and a graft copolymer. Of these, a random copolymer and a block copolymer are preferable. Further, a copolymer component may be one component or at least two components, other than methylhydrogen siloxane.

An intermediate layer coating liquid, prepared to form an intermediate layer used for the present invention, incorporates a binder resin and a dispersion solvent in addition to an N-type semiconductive particle such as the above surface-treated titanium oxide.

The ratio of an N-type semiconductive particle in an intermediate layer is preferably 1.0-2.0 times that of a binder resin in the intermediate layer in terms of volume ratio (the volume of the binder resin is designated as 1). When the N-type semiconductive particle of the present invention is used in an intermediate layer at such a high density, rectifying properties of the intermediate layer is enhanced. Therefore, even with a larger film thickness, residual potential increase and dot image deterioration are effectively prevented, and then an excellent organic photoreceptor can be formed. Further, in such an intermediate layer, 100-200 parts by volume of an N-type semiconductive particle is preferably used based on 100 parts by volume of a binder resin.

On the other hand, as a binder resin to disperse such a particle and form a layer structure of an intermediate layer, polyamide resins are preferable to realize excellent particle dispersibility. Polyamide resins described below are specifically preferable.

As a binder resin for an intermediate layer, alcohol-soluble polyamide resins are preferable. As a binder resin for an intermediate layer in an organic photoreceptor, to form an intermediate layer with a uniform film thickness, resins exhibiting excellent solvent solubility are needed. As such alcohol-soluble polyamide resins, there are known copolymerized polyamide resins having a chemical structure with a small number of carbon chains between amide bonds such as 6-nylon, as described above; and methoxymethylated polyamide resins. In addition thereto, polyamides as shown below are preferably used.

N-1

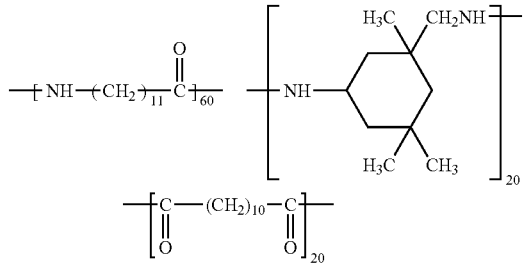

N-2

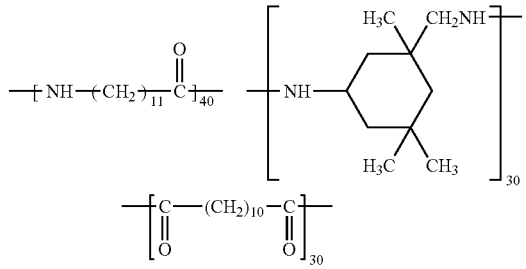

N-3

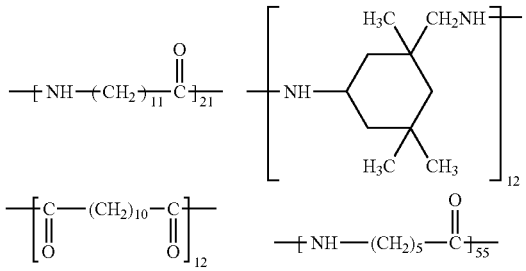

N-4

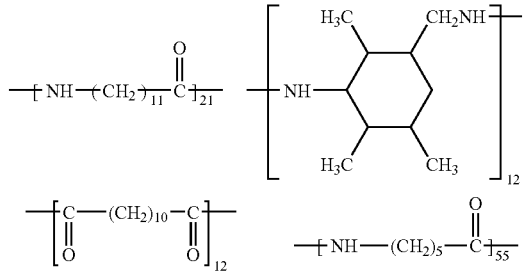

N-5

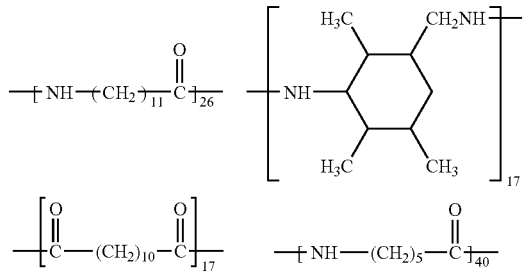

The component ratio of above polyamides N-1-N-5 is expressed in terms of mol %.

Further, the molecular weight of these polyamide resins is preferably 5,000-80,000, more preferably 10,000-60,000 in terms of number average molecular weight. When the number average molecular weight is at most 5,000, uniformity of the film thickness of an intermediate layer is deteriorated, whereby sufficient effects of the present invention are hardly produced. In contrast, in the case of more than 80,000, solvent solubility of a resin tends to decrease and aggregated resins are likely to occur, whereby black spot occurrence and dot image deterioration tend to result.

Some of the above polyamide resins are currently available on the market. For example, available are those with trade names such as VESTAMELT X1010 and X4685 (produced by Daicel-Degussa Ltd.). These can be prepared via common polyamide synthesis methods, and one of the synthesis examples is shown below.

As solvents to solve any of the above polyamide resins and to prepare a coating liquid, preferable are alcohols having 2-4 carbon atoms such as ethanol, n-propyl alcohol, isopropyl alcohol, n-butanol, t-butanol, or sec-butanol, which are excellent from the viewpoint of solubility of the polyamides and coatability of a prepared coating liquid. The content of these solvent is 30-100% by mass, preferably 40-100% by mass, more preferably 50-100% by mass based on all the solvents. Auxiliary solvents to realize preferable effects by combination with the above solvents include methanol, benzyl alcohol, toluene, methylene chloride, cyclohexane, and tetrahydrofuran.

The film thickness of the intermediate layer of the present invention is preferably 0.3-10 μm. When the film thickness of the intermediate layer is less than 0.5 μm, black spot occurrence and dot image deterioration tend to result. In the case of more than 10 μm, residual potential increase and dot image deterioration tend to occur. Accordingly, the film thickness of the intermediate layer is more preferably 0.5-5 μm.

Further, the intermediate layer is preferably a substantially insulating layer. Herein, the insulating layer has a volume resistance of at least $1\times10^{8}$ Ω·cm. The volume resistance of the intermediate layer and the protective layer of the present invention is preferably $1\times10^{8}$-$10^{15}$ Ω·cm, more preferably $1\times10^{9}$-$10^{14}$ Ω·cm, still more preferably $2\times10^{9}$-$1\times10^{13}$ Ω·cm. The volume resistance can be determined as shown below.

Determination conditions: based on JIS C2318-1975

Measurement instrument: Hiresta IP (produced by Mitsubishi Petrochemical Co., Ltd.)

Measurement condition: measurement probe HRS

Applying voltage: 500 V

Measurement ambience: 30±2° C. and 80±5 RH %

When volume resistance is less than $1\times10^{8}$ Ω·cm, charge blocking properties of an intermediate layer is decreased, whereby black spot occurrence is increased and potential retention properties of an organic photoreceptor is deteriorated, resulting in poor images. In contrast, in the case of more than $10^{15}$ Ω·cm, residual potential tends to be increased in repetitive image formation, resulting in poor images.

Photosensitive Layer

The photosensitive layer structure of the photoreceptor of the present invention may be a photosensitive layer structure composed of a monolayer structure incorporating a single layer with a charge generating function and a charge transportation function formed on the above intermediate layer, being, however, preferably a structure wherein the photosensitive layer is divided into a charge generating layer (CGL) and a charge transporting layer (CTL) each having a separately assigned function. With such a structure having the divided functions, residual potential increase due to repetitive use can be controlled to be smaller, and other electrophotographic characteristics are easily controlled to meet the intended purposes. In a negatively charged photoreceptor, preferable is such a structure that a charge transporting layer (CTL) is provided on a charge generating layer (CGL) provided on an intermediate layer.

The photosensitive layer structure of a function-divided, negatively charged photoreceptor will now be described.

Charge Generating Layer

The organic photoreceptor of the present invention incorporates a compound as represented by above Formula (1) as a charge generating material. In addition to this charge generating material, another charge generating material may be combined, if appropriate. A pigment combined includes an azo pigment, a perylene pigment, and a polycyclic quinone pigment.

A binder needs to be incorporated in a charge generating layer as a dispersion medium for a charge generating material (CGM). As the binder, conventionally known resins can be used, but most preferable resins include a formal resin, a butyral resin, a silicone resin, a silicone-modified butyral resin, and a phenoxy resin. The ratio of the charge generating material to the binder resin is preferably 20-600 parts by mass, based on 100 parts by mass of the binder resin. Use of these resins makes it possible to minimize residual potential increase due to repetitive use. The film thickness of the charge generating layer is preferably 0.3 μm-2 μm.

Charge Transporting layer

In the present invention, it is possible that a charge transporting layer is structured of a plurality of charge transporting layers, and of these, the charge transporting layer provided as the uppermost layer incorporates the inorganic fine particle of the present invention.

The charge transporting layer incorporates a charge transportation material (CTM) and a binder resin to disperse the CTM and to serve for film formation thereof. As other materials, additives such as an antioxidant may be incorporated in addition to the above inorganic fine particle, if appropriate.

As the charge transportation material (CTM), conventionally known charge transportation materials (CTMs) having positive hole transportation properties (p type) can be used. For example, triphenylamine derivatives, hydrazine compounds, styryl compounds, benzidine compounds, and butadiene compounds can be used of these, the charge transportation material of above Formula (2) having no absorption in the wavelength region of 400-500 nm is preferable. However, those having a ring structure formed by unification of $R_1$ and $R_2$ are specifically preferable.

Layer formation is commonly carried out by dissolving any of these charge transportation materials in an appropriate binder resin. The binder resin used for a charge transporting layer (CTL) may be either a thermoplastic resin or a thermally curable resin, including, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymerized resins having at least 2 types selected from the repetitive unit structures of these resins. Further, in addition to these insulating resins, polymer organic semiconductors such as poly-N-vinylcarbazole are listed. Of these, polycarbonate resins are most preferable due to small water absorption rate, CTM dispersibility, and excellent electrophotographic characteristics.

The ratio of the charge transportation material to the binder resin is preferably 50-200 parts by mass based on 100 parts by mass of the binder resin.

The total film thickness of the charge transporting layer is preferably 10-30 μm. When the total film thickness is less than 10 μm, adequate latent image potential during development are hardly achieved, whereby image density decrease and dot reproducibility deterioration tend to occur. In contrast, in the case of more than 30 μm, charge carrier spreading (spreading of charge carriers generated in a charge generating layer) is increased and then dot reproducibility tends to be deteriorated. Further, when the charge transporting layer is formed of a plurality of layers, the film thickness of a charge transporting layer, serving as the surface layer, is preferably 1.0-8.0 μm.

Solvents or dispersion media used to form layers such as an intermediate layer, a charge generating layer, and a charge transporting layer include n-butylamine, diethylamine, ethylene diamine, isopropanol amine, triethanol amine, triethylene diamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, and methyl cellosolve. However, the present invention is not limited thereto. Of these, dichloromethane, 1,2-dichloroethane, and methyl ethyl ketone are preferably used. Further of these, earth-conscious solvents such as tetrahydrofuran and methyl ethyl ketone are preferably used. Further, these solvents can be used individually or as a mixed solvent of at least 2 types.

Next, as a coating processing method to produce an organic photoreceptor, a slide hopper-type coating apparatus is used, and in addition, coating processing methods such as immersion coating or spray coating are employed.

Of these coating liquid feed-type coating apparatuses, a coating processing method using the slide hopper-type coating apparatus is most suitable when a dispersion, employing a low-boiling-point solvent as described above, is used as a coating liquid. In the case of a cylindrical photoreceptor, a circular slide hopper-type coating apparatus as detailed in JP-A No. 58-189061 is preferably used for coating.

Further, the surface layer of a photoreceptor according to the present invention preferably incorporates an antioxidant. The surface layer is easily oxidized by an active gas such as $NO_x$ or ozone generated during charging of the photoreceptor, resulting in occurrence of image unsharpness. However, by coexistence of an antioxidant, such occurrence of image unsharpness can be prevented. The antioxidant is typically a material having properties of preventing or inhibiting oxygen from producing an action on a self-oxidizing material, present in an organic photoreceptor or on the surface thereof, under conditions such as light, heat, or discharge.

Next, an image forming apparatus employing an organic photoreceptor according to the present invention will now be described.

Image forming apparatus 1 shown in FIG. 1 is an image forming apparatus based on a digital mode and composed of image reading section A, image processing section B, image forming section C, and transfer paper conveying section D as a transfer paper conveying member.

An automatic document feeding member to automatically convey an original document is arranged in the upper part of image reading section A. Original documents mounted on document stacking table 11 are conveyed, while being separated sheet by sheet by document conveying roller 12, to carry out image reading at reading position 13*a*. An original document, having been subjected to document reading, is discharged onto document discharging tray 14.

On the other hand, the image of the original document placed on platen glass 13 is read by reading operation at a rate of v of first mirror unit 15 composed of an illuminating lamp and a first mirror constituting an optical scanning system and by movement at a rate of v/2 in the same direction of second mirror unit 16 composed of a second mirror and a third mirror which are positioned in a V letter.

The read image is focused through projection lens 17 onto the light receiving surface of imaging sensor CCD which is a line sensor. The linear optical image, which has been focused onto the imaging sensor CCD, is successively subjected to photoelectric conversion into electric signals (brightness signals), and then is subjected to A/D conversion. The resulting signals are subjected to various processes such as density conversion and filtering processing in image processing section B, and thereafter, the resulting image data are temporarily stored in a memory.

In image forming section C, there are arranged, as image forming units, drum-shaped photoreceptor 21 which is an image carrier, and on the outer circumference thereof, charging member (charging process) 22 above charging photoreceptor 21, potential detecting member 220 detecting the surface potential of a charged photoreceptor, developing member (developing process) 23, transfer conveyance belt unit 45 as a transferring member (transferring process), cleaning unit 26 (cleaning process) of above photoreceptor 21, and PCL (pre-charge lamp) 27 as a light discharging member (light discharging process) in the order of each movement. Further, reflective density detecting member 222, measuring the reflective density of a patch image developed on photoreceptor 21, is provided on the downstream side of developing member 23. As photoreceptor 21, an organic photoreceptor according to the present invention is used and is rotationally driven clockwise as shown in the drawing.

Rotating photoreceptor 21 is uniformly charged by charging member 22, and image exposure is carried out based on image signals read out by an exposure optical system as image exposure member (image exposure process) 30 from the memory in image processing section B. The exposure optical system as image exposure member 30, which is a writing member, employs a laser diode as a light emitting source, although being not shown in the drawing, and primary scanning is performed by the light pass bent by reflection mirror 32 via rotating polygon mirror 31, fθ lens 34, and cylindrical lens 35, whereby image exposure is performed at the position of Ao against photoreceptor 21 to form an electrostatic latent image via rotation (secondary scanning) of photoreceptor 21. In an example of the embodiments of the present invention, an electrostatic latent image is formed via exposure on the letter portion.

In the image forming apparatus of the present invention, when an electrostatic latent image is formed on a photoreceptor, a semiconductor laser or a light-emitting diode of an oscillation wavelength of 350-500 nm is used as an image exposure light source. Using such an image exposure light source, the exposure dot diameter in the primary scanning direction of writing is narrowed to 10-50 μm, and digital exposure is performed on an organic photoreceptor to obtain an electrophotographic image at an enhanced resolution of 600 dpi (dpi: the number of dots per 2.54 cm)-2500 dpi.

Figure 4:
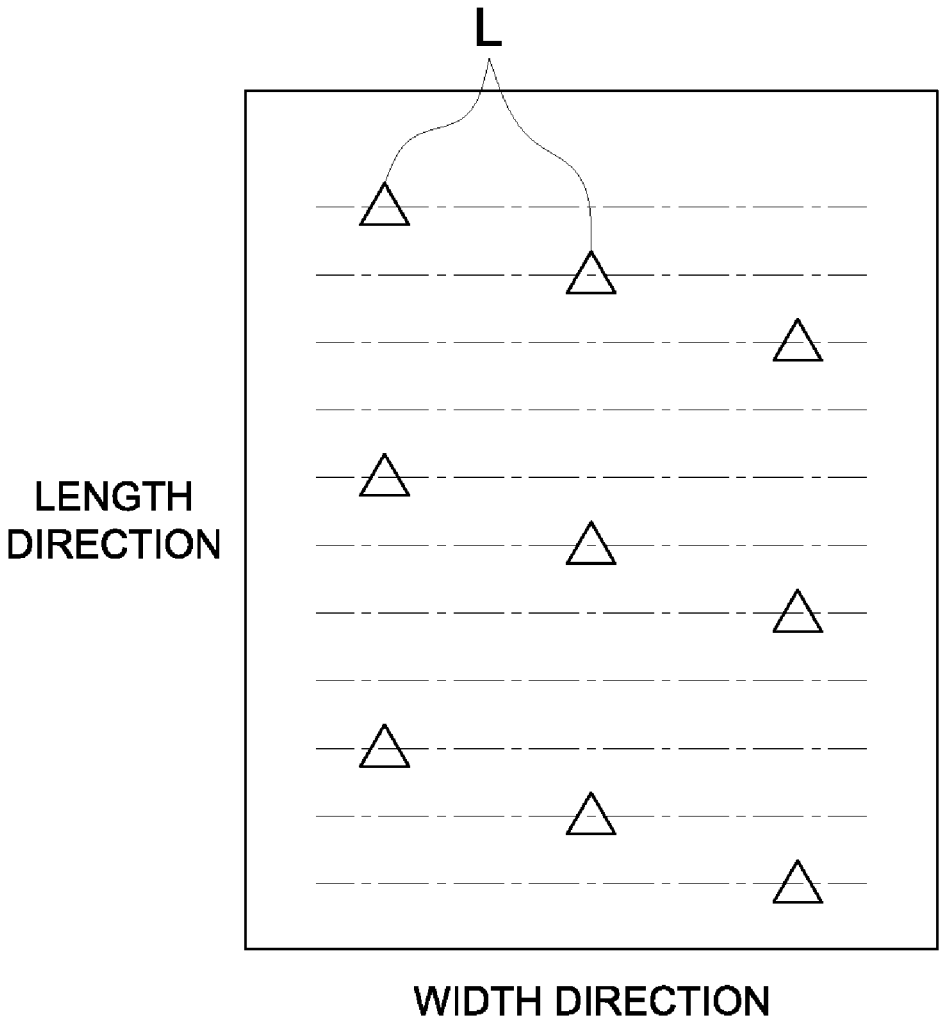
[FIG. 4] A pattern diagram of a surface-emitting laser array

As the image exposure light source employing a semiconductor laser, a surface-emitting laser array can also be used. The surface-emitting laser array refers to those having at least 3 laser beam emitting points (Ls) both in length and width directions as shown in FIG. 4.

The above exposure dot diameter refers to an exposure beam length (Ld: the maximum length is measured) in the primary scanning direction in an area in which the intensity of the exposure beam is at least $1/e^2$ of the peak intensity.

Light beams used include a scanning optical system employing a semiconductor laser and an LED solid scanner. Light intensity distribution includes Gaussian distribution and Lorentz distribution, and the exposure dot diameter of the present invention is designated for each area having a peak intensity of at least $1/e^2$.

An electrostatic latent image on photoreceptor 21 is reversely developed by developing member 23 to form a toner image, being a visual image, on the surface of photoreceptor 21. In the image forming method of the present invention, for a developer used for the developing member, a polymerized toner is preferably used. When a polymerized toner featuring a uniform shape and particle size distribution is combined with an organic photoreceptor according to the present invention, an electrophotographic image exhibiting superior sharpness can be realized.

An electrostatic latent image formed on the organic photoreceptor of the present invention is visualized as a toner image via development. A toner used in development may be a pulverized toner or a polymerized toner. However, as a toner according to the present invention, a polymerized toner produced via a polymerization method is preferable from the viewpoint of realizing stable particle size distribution.

The polymerized toner refers to a toner wherein a toner binder resin is prepared and a toner shape is formed via polymerization of a raw material monomer of the binder resin, followed by chemical treatment if appropriate, more specifically referring to a toner formed via polymerization reaction such as suspension polymerization or emulsion polymerization and then, if appropriate, via a process of self-fusion of the particles.

Incidentally, the volume average particle diameter, namely the 50% volume particle diameter (Dv50), of the toner is preferably 2-9 μm, more preferably 3-7 μm. This range makes it possible to enhance resolution. Further, combinations in the above range make it possible to realize a smaller particle diameter toner with a less existence amount of a minute particle diameter toner, whereby improved reproducibility of a dot image is achieved for a long-term period and a stable image exhibiting enhanced sharpness can be formed.

A toner according to the present invention may be used as a single-component developer or a two-component developer.

For use as the single-component developer, listed are a nonmagnetic single-component developer and a magnetic single-component developer wherein magnetic particles of about 0.1-0.5 μm is incorporated in a toner, and either thereof can be used.

Further, it is possible to use the toner as the two-component developer by mixing with carriers. In this case, it is possible to use, as magnetic particles of the carriers, materials conventionally known in the art including metals such as iron, ferrite, or magnetite and alloys of the above metals with metals such as aluminum or lead. However, ferrite particles are specifically preferable. The volume average particle diameter of the magnetic particles is preferably 15-100 μm, more preferably 25-80 μm.

The volume average particle diameter of the carriers can be determined typically with laser diffraction type particle size distribution meter "HELOS" (produced by Sympatec Co.) equipped with a wet-type homogenizer.

As the carriers, preferable are those wherein magnetic particles are further coated with a resin or so-called resin dispersion-type carriers wherein magnetic particles are dispersed in a resin. A resin composition for coating is not specifically limited. There are used, for example, olefin resins, styrene resins, styrene-acrylic resins, silicone resins, ester resins, and fluorine-containing polymer resins. Further, as a resin constituting the resin dispersion-type carriers, any appropriate resin known in the art can be used with no specific limitation, including, for example, styrene-acrylic resins, polyester resins, fluorine resins, and phenol resins.

In transfer paper conveying section D, paper feeding units 41(A), 41(B), and 41(C) are arranged as a transfer paper storing member in which sheets of transfer paper P of different size are stored in the lower part of an image forming unit, and manual paper feeding unit 42 is also arranged on the side to manually feed paper. Transfer paper P selected from any thereof is fed along conveying path 40 by guide roller 43. Then, transfer paper P is temporarily stopped by a pair of paper feeding and registration rollers 44 to correct the slant or deviation of fed transfer paper P and then is re-fed, being thereafter guided into conveying path 40, pre-transfer roller 43*a*, paper feeding path 46, and entering guide plate 47. Then, a toner image on photoreceptor 21 is transferred on transfer paper P while being mounted and conveyed on transfer conveyance belt 454 of transfer conveyance belt unit 45 at transfer position Bo by transfer pole 24 and separation pole 25. Transfer paper P is then separated from the surface of photoreceptor 21 and transferred to fixing member 50 by transfer conveyance belt unit 45.

Fixing member 50 has fixing roller 51 and pressurization roller 52, and fixes toner via heating and pressurization by allowing transfer paper P to pass between fixing roller 51 and pressurization roller 52. Transfer paper P, having been subjected to toner image fixing, is discharged onto paper discharging tray 64.

Image formation on one side of transfer paper has been described above. In the case of duplex copying, paper discharge switching member 170 is switched and transfer paper guide section 177 is opened to convey transfer paper P in the dashed arrow direction.

Further, transfer paper P is conveyed downward by conveying mechanism 178 and switched back by transfer paper turnaround section 179, and then conveyed into the inside of duplex copying paper feeding unit 130 while the end portion of transport paper P is switched to the top portion.

Transfer paper P is shifted toward the paper feeding direction through conveying guide 131 arranged in duplex copying paper feeding unit 130, and then re-fed by paper feeding roller 132 to guide transfer paper P into conveying path 40.

Transfer paper P is conveyed again toward photoreceptor 21 as described above. Then, a toner image is transferred on the rear surface of transfer paper P, fixed by fixing member 50, and then discharged onto paper discharging tray 64.

The image forming apparatus of the present invention may be constituted in such a manner that components such as a photoreceptor, a developing unit, and a cleaning unit described above are combined into a unit as a process cartridge, and then the unit may be structured so as to be fully detachable to the apparatus main body. Further, it is possible to employ the following constitution: a process cartridge is formed holding at least one of a charging unit, an image exposure unit, a developing unit, a transfer or separation unit, and a cleaning unit together with a photoreceptor to form a single unit fully detachable to the apparatus main body in such a manner that the unit is fully detachable using a guide member such as a rail of the apparatus main body.

Figure 2:
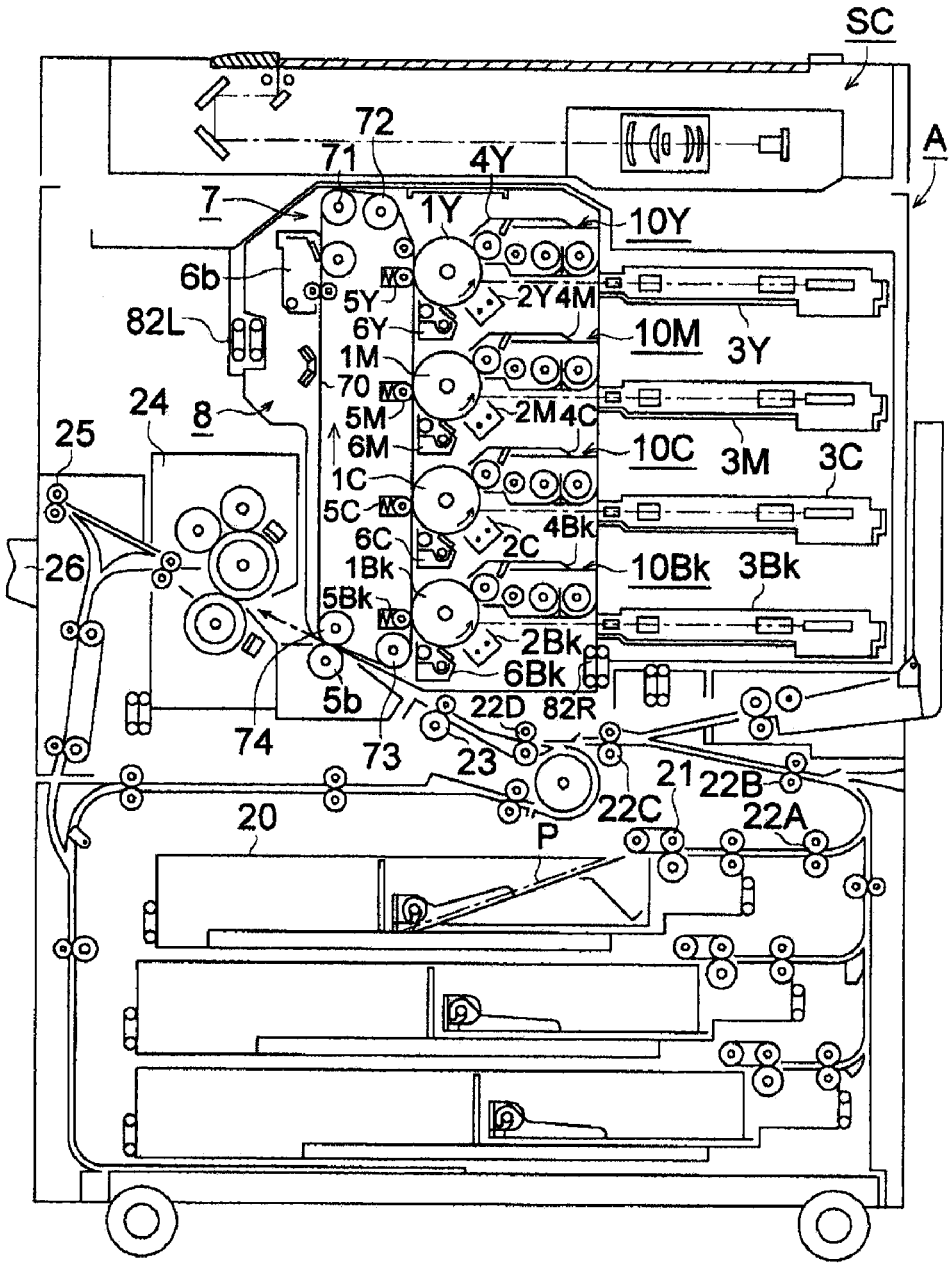
[FIG. 2] A sectional constitution view of a color image forming apparatus showing an embodiment of the present invention

FIG. 2 is a sectional constitution view of a color image forming apparatus showing one embodiment of the present invention.

This color image forming apparatus is referred to as a tandem-type color image forming apparatus, and composed of 4 image forming sections (image forming units) 10Y, 10M, 10C, and 10Bk; endless belt-shaped intermediate transfer body unit 7; paper feeding and conveying member 21; and fixing member 24. In the upper part of image forming apparatus main body A, original document image reading unit SC is arranged.

Image forming section 10Y, forming a yellow image, incorporates charging member (charging process) 2Y arranged around drum-shaped photoreceptor 1Y as a first image carrier, exposure member (exposure process) 3Y, developing member (developing process) 4Y, primary transfer roller 5Y as a primary transfer member (primary transfer process), and cleaning member 6Y. Image forming section 10M, forming a magenta image, incorporates drum-shaped photoreceptor 1M as a first image carrier, charging member 2M, exposure member 3M, developing member 4M, primary transfer roller 5M as a primary transfer member, and cleaning member 6M. Image forming section 10C, forming a cyan image, incorporates drum-shaped photoreceptor 1C as a first image carrier, charging member 2C, exposure member 3C, developing member 4C, primary transfer roller 5C as a primary transfer member, and cleaning member 6C. Image forming section 10Bk, forming a black image, incorporates drum-shaped photoreceptor 1Bk as a first image carrier, charging member 2Bk, exposure member 3Bk, developing member 4Bk, primary transfer roller 5Bk as a primary transfer member, and cleaning member 6Bk.

Above 4 image forming units 10Y, 10M, 10C, and 10Bk are composed, around centrally located photoreceptor drums 1Y, 1M, 1C, and 1Bk, of rotatable charging members 2Y, 2M, 2C, and 2Bk; image exposure member 3Y, 3M, 3C, and 3Bk; rotatable developing members 4Y, 4M, 4C, and 4Bk; and cleaning members 5Y, 5M, 5C, and 5Bk cleaning photoreceptor drums 1Y, 1M, 1C, and 1Bk, respectively.

Image forming units 10Y, 10M, 10C, and 10Bk, described above, each have the same constitution only with different toner image colors formed on photoreceptors 1Y, 1M, 1C, and 1Bk. Accordingly, image forming unit 10Y will now be detailed as an example.

In image forming unit 10Y, around photoreceptor drum 1Y which is an image forming body, there are arranged charging member 2Y (hereinafter referred to simply as charging member 2Y or charging unit 2Y), exposure member 3Y, developing member 4Y, and cleaning member 5Y (hereinafter referred to simply as cleaning member 5Y or cleaning blade 5Y) to form a toner image of yellow (Y) on photoreceptor drum 1Y. Further, in the embodiments of the present invention, with regard to image forming unit 10Y of such a type, at least photoreceptor drum 1Y, charging member 2Y, developing member 4Y, and cleaning member 5Y are provided so as to be unified.

Charging member 2Y is a member to uniformly apply a potential to photoreceptor drum 1Y. In the embodiments of the present invention, corona discharge-type charging unit 2Y is used for photoreceptor drum 1Y.

Image exposure member 3Y is a member to perform exposure onto photoreceptor drum 1Y, having been provided with a uniform potential by charging unit 2Y, based on image signals (yellow) to form an electrostatic latent image corresponding to a yellow image. For such exposure member 3Y, a semiconductor laser or a light-emitting diode of an oscillation wavelength of 350-500 μm can be used as an image exposure light source. Using such an image exposure light source, the exposure dot diameter in the primary scanning direction of writing is narrowed to 10-50 μm, and then digital exposure is carried out onto an organic photoreceptor, whereby an electrophotographic image can be obtained at an enhanced resolution of 600 dpi (dpi: the number of dots per 2.54 cm)-2500 dpi. A surface-emitting laser array as described above can also be used. Further, there can be used those composed of an LED, wherein light-emitting elements are array-arranged in the axial direction of photoreceptor drum 1Y, and an imaging element (trade name: SELFOC lens).

The image forming apparatus of the present invention may be constituted in such a manner that components such as a photoreceptor, a developing unit, and a cleaning unit described above are combined into a unit as a process cartridge (image forming unit), and then this image forming unit may be structured so as be fully detachable to the apparatus main body. Further, it is possible to employ the following constitution: a process cartridge (image forming unit) is formed holding at least one of a charging unit, an image exposure unit, a developing unit, a transfer or separation unit, and a cleaning unit together with a photoreceptor to form a single image forming unit fully detachable to the apparatus main body in such a manner that the unit is fully detachable using a guide member such as a rail of the apparatus main body.

Endless belt-shaped intermediate transfer body unit 7, which is wound around a plurality of rollers, has endless belt-shaped intermediate transfer body 70 as a semiconductive endless belt-shaped second image carrier which is rotatably held.

Each color image formed by image forming units 10Y, 10M, 10C, and 10Bk is successively transferred onto rotating endless belt-shaped intermediate transfer body 70 via primary transfer rollers 5Y, 5M, 5C, and 5Bk as primary transfer members to form a composed color image. Transfer material P as a transfer material (a support to carry the final fixed image, for example, plain paper or a transparent sheet) loaded in paper feeding cassette 20 is fed by paper feeding member 21, and passes through a plurality of intermediate rollers 22A, 22B, 22C, and 22D, and registration roller 23, followed by being conveyed by secondary transfer roller 5*b*, serving as a secondary transfer member, whereby secondary transfer is carried out onto transfer material P for collective transferring of several color images. Transfer material P, on which color images have been transferred, is subjected to fixing treatment using fixing member 24, and is nipped by paper discharging rollers 25 and deposited on paper discharging tray 26 outside the apparatus. Herein, a transfer support of a toner image formed on a photoreceptor such as an intermediate transfer body or a transfer material collectively refers to a transfer medium.

On the other hand, after color images are transferred onto transfer material P by secondary transfer roller 5*b* as a secondary transfer member, the residual toner on endless belt-shaped intermediate transfer body 70, which has been curvature-separated from transfer material P, is removed by cleaning member 6*b*.

During image forming treatment, primary transfer roller 5Bk is always in pressure contact with photoreceptor 1Bk. Other primary transfer rollers 5Y, 5M, and 5C are brought into pressure contact with each of corresponding photoreceptors 1Y, 1M, and 1C only during color image formation.

Secondary transfer roller 5*b* is brought into pressure contact with endless belt-shaped intermediate transfer body 70, only when transfer material P passes a specified position and secondary transfer is carried out.

Further, chassis 8 is structured so as to be withdrawn from apparatus main body A via supporting rails 82L and 82R.

Chassis 8 is composed of image forming sections 10Y, 10M, 10C, and 10Bk, and endless belt-shaped intermediate transfer body unit 7.

Image forming sections 10Y, 10M, 10C, and 10Bk are tandemly arranged in the perpendicular direction. Endless belt-shaped intermediate transfer body unit 7 is arranged on the left side of photoreceptors 1Y, 1M, 1C, and 1Bk as shown in the drawing. Endless belt-shaped intermediate transfer body unit 7 is composed of rotatable endless belt-shaped intermediate transfer body 70 wound around rollers 71, 72, 73, and 74, primary transfer rollers 5Y, 5M, 5C, and 5Bk, and cleaning member 6*b*.

Figure 3:
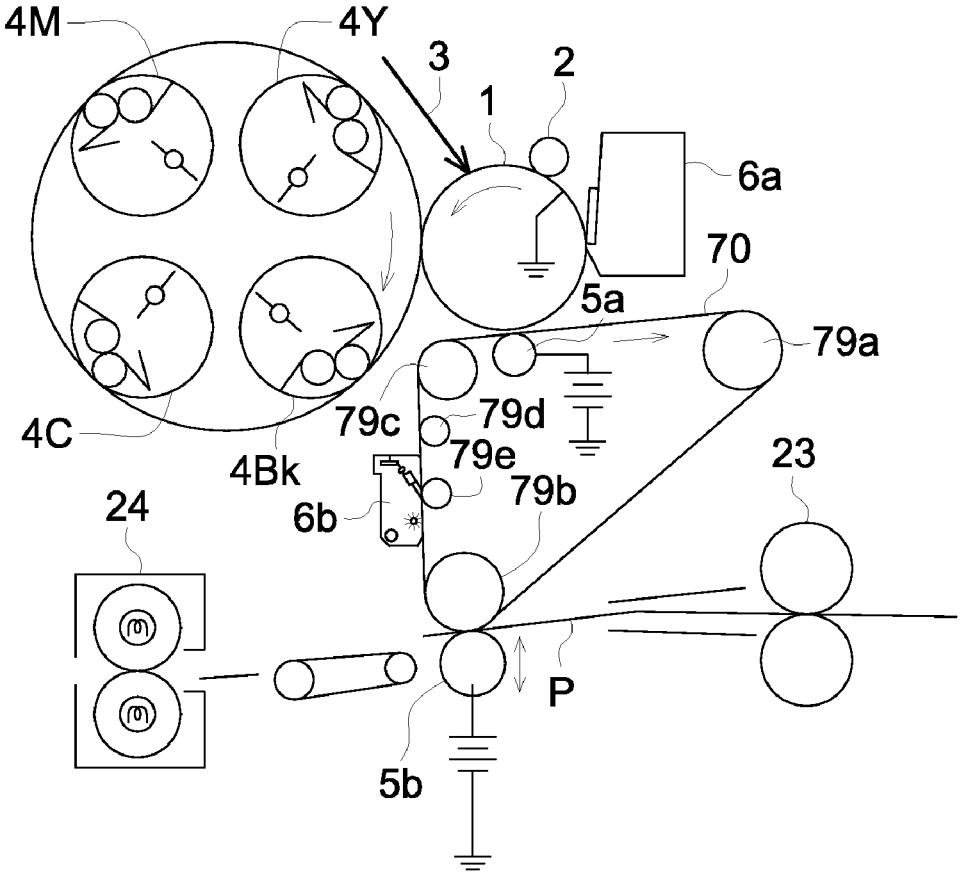
[FIG. 3] A sectional constitution view of a color image forming apparatus employing the organic photoreceptor of the present invention

FIG. 3 is a sectional constitution view of a color image forming apparatus (a copier or a laser beam printer having at least a charging member, an exposure member, a plurality of developing members, a transfer member, a cleaning member, and an intermediate transfer body around an organic photoreceptor) employing the organic photoreceptor of the present invention. An elastic material of a medium resistance is used as belt-shaped intermediate transfer body 70.

Numeral 1 is a rotatable drum-type photoreceptor which is repeatedly used as an image forming body and rotationally driven at a specified peripheral rate in the counter-clockwise direction as shown by the arrow.

During rotation, photoreceptor 1 is uniformly charged at a specified polarity and potential by charging member (charging process) 2, and then is subjected to image exposure by image exposure member (image exposure process) 3 (not shown) via scanning exposure light using laser beams modulated in response to chronological electric digital pixel signals of image information to form an electrostatic latent image corresponding to a color component image (color information) of yellow (Y) of the targeted color image.

Subsequently, the resulting electrostatic latent image is developed by yellow (Y) developing member, that is, developing process (yellow developing unit) 4Y using a yellow toner which forms the first color image. During the above operation, each of second-fourth developing members (the magenta developing unit, the cyan developing unit, and the black developing unit) 4M, 4C, and 4Bk is not operated and produces no action on photoreceptor 1, whereby the yellow toner image as the first color image is not affected by the second-fourth developing units.

Intermediate transfer body 70 is stretched around rollers 79*a*, 79*b*, 79*c*, 79*d*, and 79*e*, and rotationally driven in the clockwise direction at the same peripheral rate as photoreceptor 1.

While the yellow toner image as the first color, having been formed and carried on photoreceptor 1, passes the nip section of photoreceptor 1 and intermediate transfer body 70, the image is successively subjected to intermediate transfer (primary transfer) onto the outer circumference surface of intermediate transfer body 70 via an electric field formed by primary transfer bias applied to intermediate transfer body 70 from primary transfer roller 5*a*.

The surface of photoreceptor 1, having completed transfer of the yellow toner image as the first color corresponding to intermediate transfer body 70, is cleaned by cleaning unit 6*a*.

Thereafter, in the same manner as above, a magenta toner image as the second color, a cyan toner image as the third color, and a black toner image as the fourth color are successively transferred onto intermediate transfer body 70 in a superposed manner to form a superposed color toner image corresponding to the targeted color image.

Secondary transfer roller 5*b* is subjected to bearing in parallel to secondary transfer facing roller 79*b* and is arranged in the bottom surface part of intermediate transfer body 70 so as to be withdrawn.

The primary transfer bias to carry out successive superposing transfer of toner images of the first-fourth colors onto intermediate transfer body 70 from photoreceptor 1 exhibits polarity opposite to that of the toner and is applied from a bias power source. The applied voltage is, for example, in the range of +100 V-+2 kV.

During the primary transfer process of toner images of the first-third colors from photoreceptor 1 to intermediate transfer body 70, secondary transfer roller 5*b* and intermediate transfer body cleaning member 6*b* may be withdrawn from intermediate transfer body 70.

Transfer of the superposed color toner image, having been transferred onto belt-shaped intermediate transfer body 70, onto transfer material P as a second image carrier is carried out in such a manner that secondary transfer roller 5*b* is brought into pressure contact with the belt of intermediate transfer body 70 and transfer material P is fed at specified timing to the contact nip between secondary transfer roller 5*b* and the belt of intermediate transfer body 70 through a transfer paper guide from paired paper feeding registration rollers 23. Secondary transfer bias is applied to secondary transfer roller 5*b* from a bias power source. Via this secondary transfer bias, the superposed color toner image is transferred (secondary transfer) onto transfer material P, which is the second image carrier, from intermediate transfer body 70. Transfer material P, which has been subjected to transfer of the toner image, is conveyed to fixing member 24 and thermally fixed.

The image forming apparatus of the present invention is applied to common electrophotographic apparatuses such as electrophotographic copiers, laser printers, LED printers, or liquid crystal shutter-type printers. In addition, it is possible to find wide applications in display, recording, short-run printing, plate making, and apparatuses such as facsimile machines to which electrophotographic technology is applied.

EXAMPLES

The present invention will now be detailed with reference to examples, but the embodiments of the present invention are not limited thereto. Incidentally, "part" referred to in the following sentences represents "part by mass."

Production of Photoreceptor 1

Photoreceptor 1 was produced in the following manner.

The surface of a cylindrical aluminum support was subjected to cutting work to prepare a conductive support of 10-point surface roughness Rz of 0.7 μm.

<Intermediate Layer>

An intermediate layer dispersion described below was twofold diluted with the same mixed solvent as for the dispersion and allowed to stand overnight, followed by filtration (filter: RIGIMESH filter; nominal filtration accuracy: 5 μm; pressure: 50 kPa; produced by Nihon Pall Ltd.) to prepare an intermediate layer coating liquid.

| (Preparation of Intermediate Layer Dispersion) | |
|---|---|
| Binder resin (exemplified polyamide N-1) | 1 part (1.00 part by volume) |
| N-type semiconductive particles: rutile-form titanium oxide A1 (primary particle diameter 35 nm; those surface-treated using a copolymer (mole ratio of 1:1) of methylhydrogen siloxane and dimethylsiloxane at an amount of 5% by mass based on the total mass of titanium oxide) | 3.5 parts (1.0 part by volume) |
| Ethanol/n-propyl alcohol/THF (mass ratio of 45/20/30) | 10 parts |

The above components were mixed and dispersed using a sand mill homogenizer for 10 hours in a batch manner to prepare an intermediate layer dispersion.

The intermediate layer dispersion was coated on the above conductive support, followed by being dried at 120° C. for 30 minutes to form an intermediate layer of a dry film thickness of 1.0 μm.

| (Charge Generating Layer: CGL) | |
|---|---|
| Charge generating material (CGM): sublimation-purified pigment (CGM-1) obtained in synthesis example 1 | 7 parts |
| Binder resin: polyvinyl butyral resin "S-LEC BL-X" (produced by Sekisui Chemical Co., Ltd.) | 1 part |
| 2-butanone/cyclohexanone = 4/1 | 250 parts |

The above compositions were mixed and dispersed using a sand mill homogenizer filled with glass beads at 600 rpm for hours to prepare a charge generating layer coating liquid. This coating liquid was coated via an immersion coating method to form a charge generating layer of a dry film thickness of 0.5 μm on the above intermediate layer.

| (Charge Transporting layer (CTL)) | |
|---|---|
| Charge transportation material (CTM): exemplified compound CTM-1 | 225 parts |
| Polycarbonate (Z300, produced by Mitsubishi Gas Chemical Company, Inc.) | 300 parts |
| Antioxidant (AO-1 to be shown later) | 6 parts |
| THF/toluene mixed liquid (mixed volume ratio: 3/1) | 2000 parts |
| Silicone oil (KF-54, Shin-Etsu Chemical Co., Ltd.) | 1 part |

The above compositions were mixed and dissolved to prepare a charge transporting layer coating liquid. This coating liquid was coated on the above-prepared charge generating layer via an immersion coating method and dried at 110° C. for 70 minutes, followed by formation of charge transporting layer 1 of a dry film thickness of 20.0 μm to produce photoreceptor 1.

AO-1

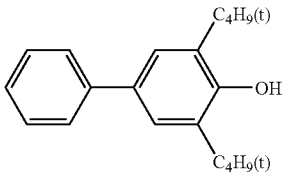

Production of Photoreceptor 2

Photoreceptor 2 was produced in the same manner as in production of photoreceptor 1 except that the dispersion conditions for the charge generation layer coating liquid were changed to 1000 rpm and 15 hours.

Production of Photoreceptor 3

Photoreceptor 3 was produced in the same manner as in production of photoreceptor 2 except that polyvinyl butyral resin "S-LEC BL-X" (produced by Sekisui Chemical Co., Ltd.), serving as a binder resin of the charge generating layer, was exchanged to polyvinyl butyral resin "S-LEC BX-1" (produced by Sekisui Chemical Co., Ltd.).

Production of Photoreceptor 4

Photoreceptor 4 was produced in the same manner as in production of photoreceptor 2 except that the amount of polyvinyl butyral resin "S-LEC BL-X" (produced by Sekisui Chemical Co., Ltd.), serving as a binder resin of the charge generating layer, was changed from 1 part to 2 parts.

Production of Photoreceptor 5

Photoreceptor 5 was produced in the same manner as in production of photoreceptor 1 except that CTM-1 as a CTM of the charge transporting layer was replaced with CTM-6.

Production of Photoreceptor 6

Photoreceptor 6 was produced in the same manner as in production of photoreceptor 2 except that CTM-1 as a CTM of the charge transporting layer was replaced with CTM-10.

Production of Photoreceptor 7 (Comparative Example)

Photoreceptor 7 was produced in the same manner as in production of photoreceptor 2 except that no binder resin of the charge generating layer was used.

Production of Photoreceptor 8 (Comparative Example)

Photoreceptor 8 was produced in the same manner as in production of photoreceptor 2 except that CGM-1, serving as a charge generating material, was replaced with a one-stage sublimation-purified pigment (CGM-2) obtained in following synthesis example 2.

SYNTHESIS EXAMPLE 2

(One-Stage Sublimation)

Five grams of the pigment raw product obtained in synthesis example 1 was placed in a graphite crucible arranged in a vacuum deposition apparatus and heated under a reduced pressure of about 133.3 Pa-13.3 Pa at 480° C. Deposition was carried out onto a substrate placed 15 cm above an evaporation source to obtain 3.6 g of a sublimated material (CGM-2).

Production of Photoreceptor 9 (Comparative Example)

Photoreceptor 9 was produced in the same manner as in production of photoreceptor 1 except that CGM-1, serving as a charge generating material, was replaced with a sublimation-purified fine-particulated pigment (CGM-3) obtained in following synthesis example 3.

SYNTHESIS EXAMPLE 3

(Fine Particulation)

One part of the sublimation-purified pigment obtained in synthesis example 1 was dissolved in 30 parts of chlorosulfuric acid and then poured into 500 g of ice. After filtration, washing was carried out to neutralize the cleaning liquid, followed by drying to obtain a purified fine-particulated pigment (CGM-3).

Production of Photoreceptor 10 (Comparative Example)

Photoreceptor 10 was produced in the same manner as in production of photoreceptor 1 except that the charge generating layer was formed with a vacuum deposition film prepared from the sublimation-purified pigment, obtained in synthesis example 1, placed in a molybdenum boat under a reduced pressure of about $1\times10^{-2}$ Pa.

With regard to above photoreceptors 1-10, in addition to the photoreceptors having a cylindrical aluminum support, sheet-shaped photoreceptors 1-10 were also produced, for evaluation of items such as sensitivity using EPA-8100 to be described later, in such a manner that an intermediate layer, a charge generating layer, and a charge transporting layer were each layered on a aluminum deposited PET (registered) base under the same conditions as described above.

Preparation of Spectral Absorption Spectrum Measurement Samples (CGL-1-CGL-10) of Charge Generating Layer A charge generating layer of each of above photoreceptor 1-photoreceptor 10 was formed on a transparent polyester film via coating or deposition at the same film thickness as the photoreceptor to prepare spectral absorption spectrum measurement samples of BS-1-BS 10. The spectral absorption spectra of CGL-1, 2, 9, and 10 are shown in FIGS. 5, 6, 7, and 8, respectively.

<<Evaluation 1>>

Each of the spectral absorption spectra of charge generating layers (CGL-1-CGL-10) was measured via the method described above to evaluate the presence or absence of maximum absorption values each in the region of 430-445 nm, 500-510 nm, and 530-545 nm. The results are shown in Table 1. Further, typical examples of these absorption spectra were shown in FIG. 5-FIG. 10.

TABLE 1

Figure 5:
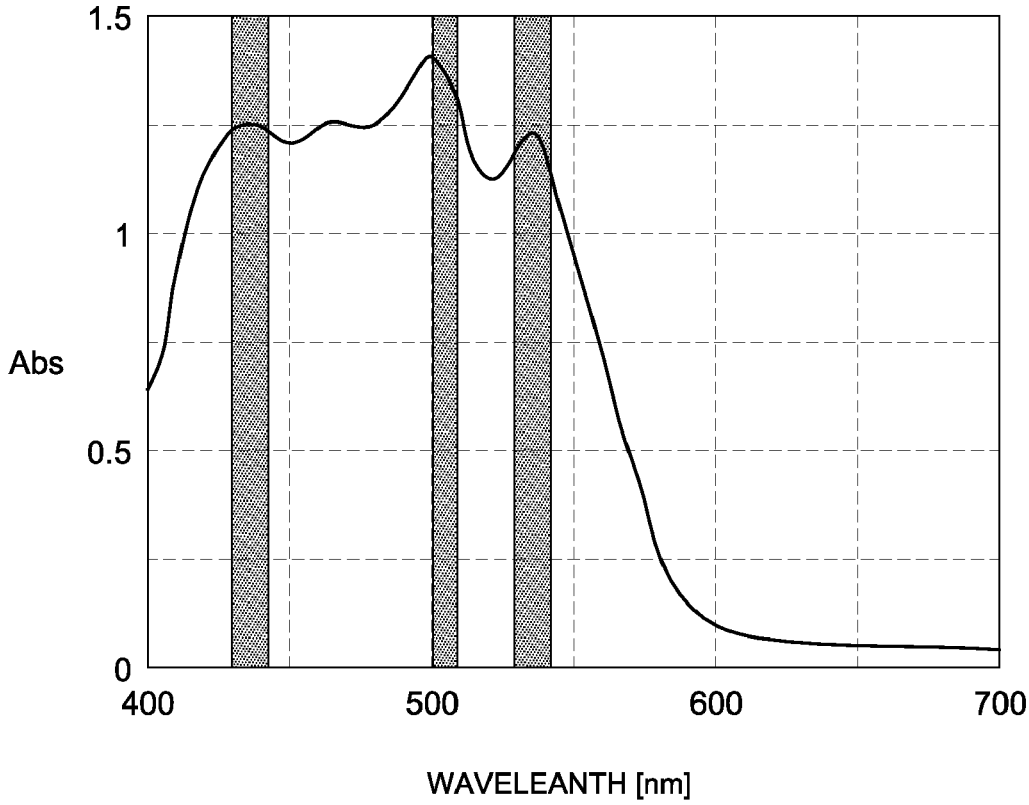
[FIG. 5] A figure of the spectral absorption spectrum of a charge generating layer in photoreceptor 1
Figure 6:
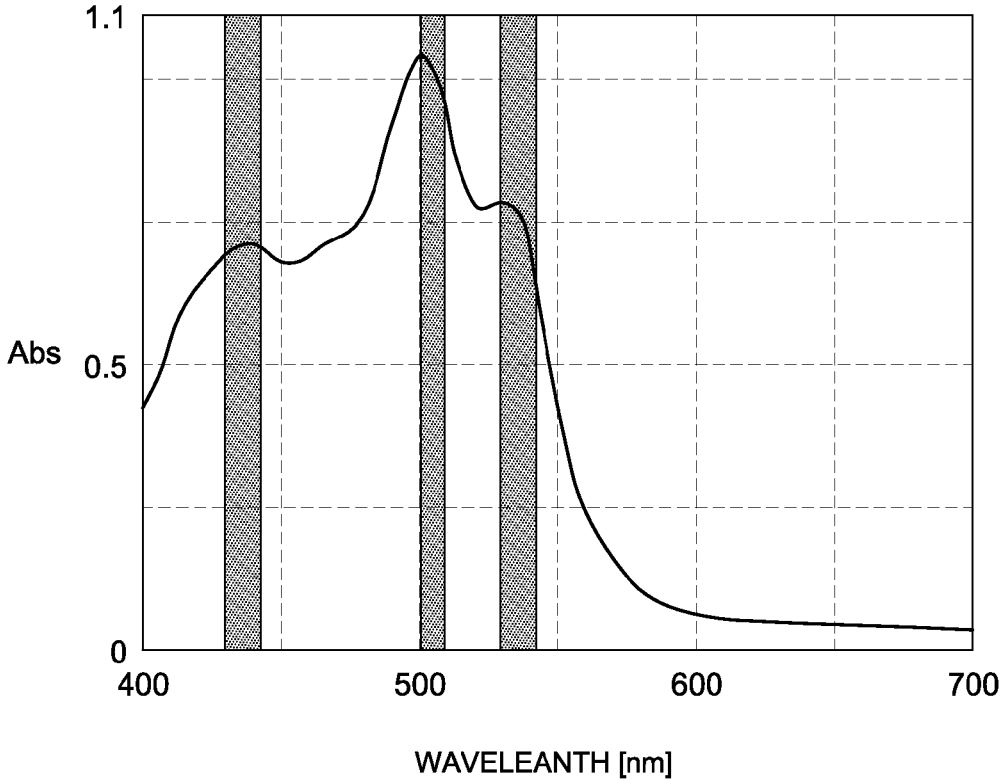
[FIG. 6] A figure of the spectral absorption spectrum of a charge generating layer in photoreceptor 2
Figure 7:
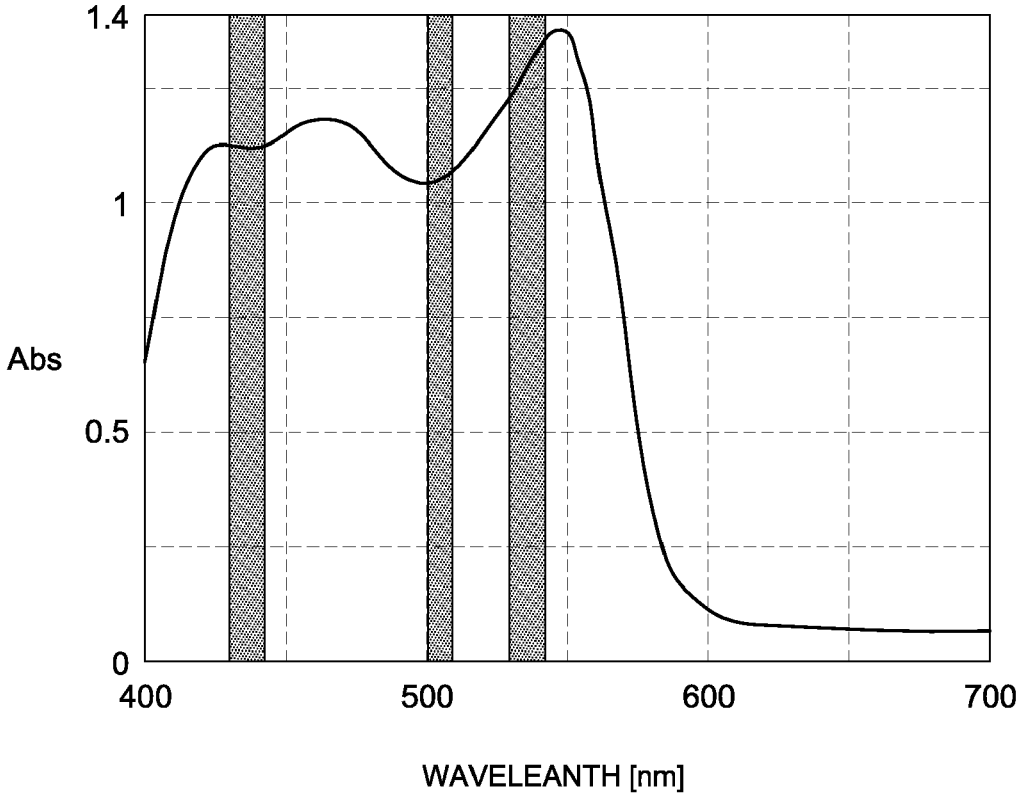
[FIG. 7] A figure of the spectral absorption spectrum of a charge generating layer in photoreceptor 9
Figure 8:
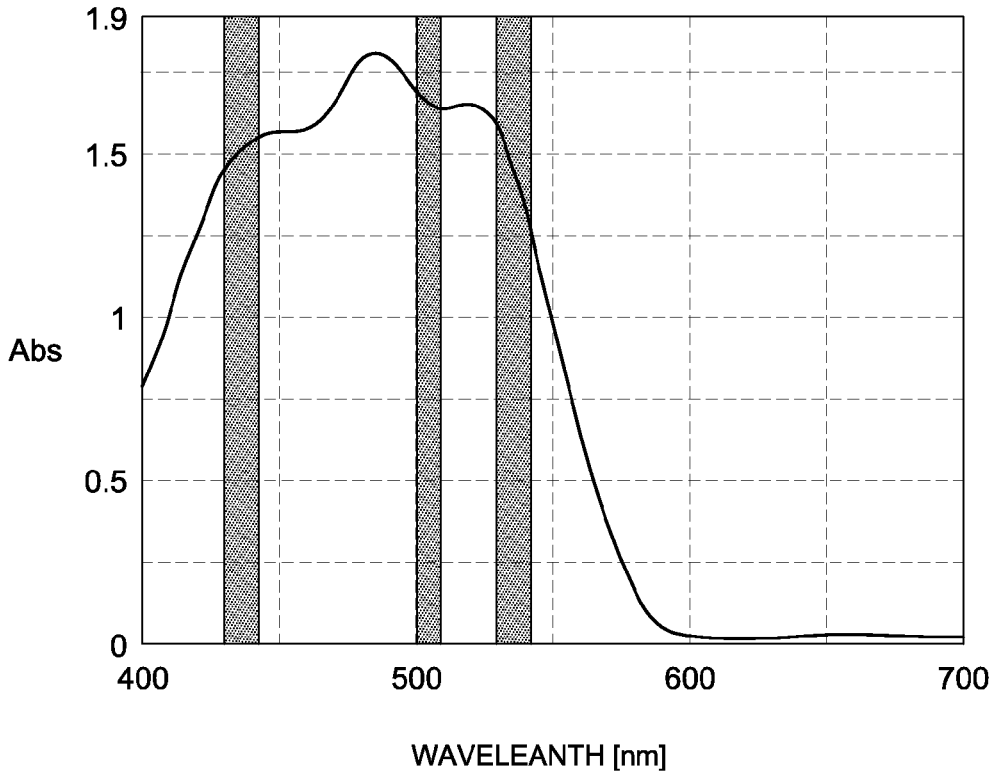
[FIG. 8] A figure of the spectral absorption spectrum of a charge generating layer in photoreceptor 10

| CGL No. | Region 1 430-445 nm | Region 2 500-510 nm | Region 3 530-545 nm | Figure of Spectral Spectrum | Remarks |
|---|---|---|---|---|---|
| 1 | A | A | A | FIG. 5 | Inventive |
| 2 | A | A | A | FIG. 6 | Inventive |
| 3 | A | A | A | — | Inventive |
| 4 | A | A | A | — | Inventive |
| 5 | A | A | A | — | Inventive |
| 6 | A | A | A | — | Inventive |
| 7 | A | A | A | — | Comparative |
| 8 | A | B | B | — | Comparative |
| 9 | A | B | B | FIG. 7 | Comparative |
| 10 | B | B | B | FIG. 8 | Comparative |

In Table 1, A represents the presence of a maximum absorption value in any of the above regions, and B represents no presence of a maximum absorption value.

<<Evaluation 2>>

Each of the photoreceptors produced above was evaluated as described below using an electrostatic copy paper analyzer (EPA-8100, produced by Kawaguchi Electric Works Co., Ltd.).

(Sensitivity)

A photoreceptor was charged using a corona charger at a surface potential of −700 V, and then exposed to monochromatic light of 400 nm separated using a monochromator. Sensitivity (E1/2) was determined via measurement of the amount of light required to attenuate the surface potential to −350 V.

In the same manner, sensitivity with respect to monochromatic light of 450 nm and 500 nm was determined.

(Repetition Characteristics)

Subsequently, initial dark potential (Vd) and initial light potential (Vl) were set approximately at −700 V and −200 V, respectively. Then, using monochromatic light of 450 nm, charging and exposure were repeatedly carried out 3000 times to determine the amount of variation of Vd and Vl (ΔVd and ΔVl).

The above results are shown in Table 2.

Herein, the minus symbol in the table shown below represents a decrease in potential, while the plus symbol represents an increase in potential.

(Image Evaluation)

Using Konica Minolta's digital multifunction peripheral bizhub920 modified machine (modified in such a manner that a semiconductor laser of 405 nm was used as an image exposure light source; exposure of a beam diameter of 30 μm was carried out at 1200 dpi; and the process rate was 400 mm/second) as an evaluation machine, evaluation was performed by mounting each of photoreceptor 1-10 on the multifunction peripheral. Evaluation items and criteria are shown below.

Evaluation of 1 Dot Line

An image of 1 dot line and solid black was produced on A4 white background paper to carry out evaluation based on the following criteria.

A: 1 dot line is continuously reproduced and the image density of solid black is at least 1.2 (excellent).

B: 1 dot line is continuously reproduced but the image density of solid black is 1.0—less than 1.2 (practically unproblematic).

C: 1 dot line is discontinuously reproduced; or 1 dot line is continuously reproduced but the image density of solid black is less than 1.0 (practically problematic).

Evaluation of 2 Dot Line

A white line of 2 dot line was formed in a solid black image to carry out evaluation based on the following criteria.

A: A white line of 2 dot line is continuously reproduced and the image density of solid black is at least 1.2 (excellent).

B: A white line of 2 dot line is continuously reproduced but the image density of solid black is 1.0—less than 1.2 (practically unproblematic).

C: A white line of 2 dot line is discontinuously reproduced; or a white line of 2 dot line is continuously reproduced but the image density of solid black is less than 1.0 (practically problematic).

The image densities described above were determined using RD-918 (produced by Macbeth Co.) as relative reflection densities, provided that the reflection density of paper was designated as "0." The results are shown in Table 2.

TABLE 2

| Photoreceptor | Sensitivity E½ (μJ/cm²) | | | Repetition Characteristics (V) | | Image Evaluation | |
|---|---|---|---|---|---|---|---|
| | | | | | | 1 Dot Line | 2 Dot Line |
| No. | 400 nm | 450 nm | 500 nm | ΔVd (V) | ΔV1 (V) | Reproduction | Reproduction |
| 1 | 1 | 0.27 | 0.25 | −10 | 18 | B | A |
| 2 | 2 | 0.20 | 0.23 | −14 | 12 | A | A |
| 3 | 3 | 0.22 | 0.24 | −16 | 22 | A | A |
| 4 | 4 | 0.23 | 0.25 | −20 | 10 | B | A |
| 5 | 5 | 0.26 | 0.24 | −10 | 13 | A | A |
| 6 | 6 | 0.17 | 0.20 | −10 | 5 | A | A |
| 7 | 7 | 0.29 | 0.32 | −62 | 31 | C | B |
| 8 | 8 | 0.30 | 0.34 | −30 | 77 | C | C |
| 9 | 9 | 0.39 | 0.35 | −105 | 42 | C | C |
| 10 | 10 | 0.34 | 0.42 | −55 | 30 | C | C |

Table 1 and Table 2 clearly show that organic photoreceptors 1-6, wherein a charge generating layer incorporates a binder resin and a compound represented by Formula (1) as a charge generating material and the spectral spectrum of the charge generating layer has maximum absorption values each in the region of 430-445 nm, 500-510 nm, and 530-545 nm, exhibit excellent sensitivity characteristics and repetition characteristics when light of 400-500 nm such as a relatively short wavelength laser beam is irradiated, and further exhibit excellent 1 dot line and 2 dot line reproducibility in image evaluation using a short wavelength laser beam of 405 nm.

In contrast, with regard to photoreceptor 7 employing no binder resin in its charge generating layer, pigment dispersibility is deteriorated, and sensitivity characteristics and repetition potential characteristics, as well as 1 dot line reproducibility, are deteriorated.

Further, with regard to photoreceptor 8 wherein sublimation purification of a charge generating material was carried out via one-stage sublimation purification and photoreceptor 9 wherein a charge generating material was sublimation-purified and further chemically purified, it is presumed that the crystal structure of a pigment was changed in a large extent, whereby the spectral spectrum exhibits no maximum absorption value in any region of 430-445 nm, 500-510 nm, and 530-545 nm, and sensitivity characteristics and repetition potential characteristics, as well as 1 dot line and 2 dot line reproducibility, are deteriorated.

Further, with regard to photoreceptor 10 wherein a charge generating layer was produced via vapor deposition, no maximum absorption value in any region of 430-445 nm, 500-510 nm, and 530-545 nm appears, and then sensitivity characteristics and repetition potential characteristics, as well as 1 dot line and 2 dot line reproducibility, are deteriorated.

Evaluation 3

In the image evaluation conditions for above evaluation 2, the beam diameter was changed from 30 μm to 18 μm and the resolution was changed from 1200 dpi to 1800 dpi, and then image evaluation was carried out under the same conditions as for evaluation 2 except that photoreceptors 1, 2, and 3 were used.

The evaluation results showed that an image obtained from each of photoreceptors 1, 2, and 3 exhibited excellent 1 dot line and 2 dot line reproducibility.

Evaluation 4

Color image evaluation was carried out wherein each of above photoreceptor 1, 2, and 3 was mounted on full-color digital multifunction peripheral bizhub C550 modified machine incorporating a commercially available intermediate transfer body basically having the structure shown in FIG. 2 (a modified machine of a model produced by Konica Minolta Business Technologies, Inc., which was modified in such a manner that a semiconductor laser of 405 nm was used as an image exposure light source of the exposure member; exposure of a beam diameter of 30 μm was carried out at 1200 dpi; and the process rate was 220 mm/second).

In evaluation, 1 dot line evaluation and 2 dot line evaluation were carried out in the same manner as in image evaluation of above evaluation 2. A color image obtained from each of photoreceptors 1, 2, and 3 exhibited excellent 1 dot line and 2 dot line reproducibility, which showed that a color image exhibiting excellent color reproducibility was realized.

Evaluation 5

Color image evaluation was carried out wherein each of above photoreceptor 1, 2, and 3 was mounted on full-color digital multifunction peripheral bizhub C550 modified machine incorporating a commercially available intermediate transfer body basically having the structure shown in FIG. 2 (a modified machine of a model produced by Konica Minolta Business Technologies, Inc., which was modified in such a manner that the exposure member was changed to a surface-emitting laser array described below; exposure of each laser beam diameter of 30 μm was carried out at 1200 dpi; and the process rate was 220 mm/second).

Surface-Emitting Laser Array

A surface-emitting laser array as exemplified in FIG. 4 was used. The surface-emitting laser array, featuring an oscillation wavelength of 405 nm, is arranged so that no beam emitting points are overlapped either in length direction (in the secondary scanning direction) or in width direction (in the primary scanning direction).

As the surface-emitting laser array, one having 36 beam emitting points in a 6×6 matrix manner both in length and width directions was used. Actual usage is restricted by control requirements in the computer [namely n-th power of 2 (in this case, 25)]. Accordingly, of 36 beam emitting points, scanning was carried out using 32 beam emitting points to write 32 lines.

In evaluation, 1 dot line evaluation and 2 dot line evaluation were carried out in the same manner as in image evaluation of above evaluation 2. A color image obtained from each of photoreceptors 1, 2, and 3 exhibited excellent 1 dot line and 2 dot line reproducibility, which showed that a color image exhibiting excellent color reproducibility was realized.

What is claimed is:

1. An organic photoreceptor comprising a conductive support provided thereon, a charge generating layer and a charge transporting layer, wherein the charge generating layer comprises a binder resin and a mixture of at least two types of compounds, each represented by Formula (1) having a different substitution degree of bromine atom relative to each other, and a spectrum of the charge generating layer has peak absorption values each in the region of 430-445 nm, 500-510 nm and 530-545 nm, Formula (1)

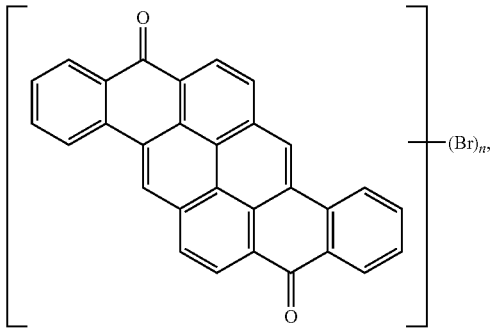

wherein n is an integer of 1-6.

2. The organic photoreceptor of claims 1, wherein the charge transporting layer incorporates a compound represented by Formula (2), Formula (2)

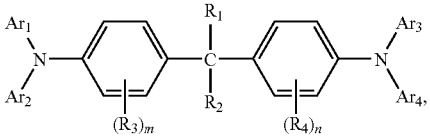

wherein $R_1$ and $R_2$ each represent an alkyl group or an aryl group independently and $R_1$ and $R_2$ may be joined to form a ring structure; $R_3$ and $R_4$ each represent a hydrogen atom, an alkyl group, or an aryl group independently; $Ar_1$-$Ar_4$ each represent a substituted or unsubstituted aryl group and $Ar_1$-$Ar_4$ may be the same or differ; $Ar_1$ and $Ar_2$ or $Ar_3$ and $Ar_4$ may be joined to form a ring structure; and m and n represent an integer of 1-4.

3. An image forming apparatus comprising:

the organic photoreceptor of claim 1;

a charging member to charge the organic photoreceptor;

an exposure member to form an electrostatic latent image via exposure to the organic photoreceptor charged by the charging member;

a developing member to form a toner image via toner development of the electrostatic latent image; and a transfer member to transfer the toner image from the organic photoreceptor to a transfer medium, wherein the exposure diameter in the primary scanning direction of writing in the exposure member is 10-50 μm.

4. An image forming apparatus comprising:

the organic photoreceptor of claim 1;

a charging member to charge the organic photoreceptor;

an exposure member to form an electrostatic latent image via exposure to the organic photoreceptor charged by the charging member;

a developing member to form a toner image via toner development of the electrostatic latent image; and a transfer member to transfer the toner image from the organic photoreceptor to a transfer medium, wherein the exposure member incorporates an exposure light source emitting monochromatic light of a wavelength region of 350-500 nm.

5. An image forming apparatus comprising:

the organic photoreceptor of claim 1;

a charging member to charge the organic photoreceptor;

an exposure member to form an electrostatic latent image via exposure to the organic photoreceptor charged by the charging member;

a developing member to form a toner image via toner development of the electrostatic latent image; and a transfer member to transfer the toner image from the organic photoreceptor to a transfer medium, wherein the exposure member incorporates a surface-emitting laser array as an exposure light source, which emits a light of a wavelength region of 350-500 nm, and is composed of at least 3 laser beam emitting points in a length direction and at least 3 laser beam emitting points in a width direction.

6. An image forming apparatus of claim 3, wherein a write density is 1,200 dpi or more.

7. An image forming apparatus of claim 4, wherein a write density is 1,200 dpi or more.

8. An image forming apparatus of claim 5, wherein a write density is 1,200 dpi or more.

* * * * *